US009879673B2

(12) United States Patent
Su et al.

(10) Patent No.: US 9,879,673 B2
(45) Date of Patent: Jan. 30, 2018

(54) SCROLL COMPRESSOR

(71) Applicant: EMERSON CLIMATE TECHNOLOGIES (SUZHOU) CO., LTD., Jiangsu (CN)

(72) Inventors: Xiaogeng Su, Suzhou (CN); Weihua Guo, Jiangsu (CN); Qingfeng Sun, Jiangsu (CN); Zhen Hu, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 113 days.

(21) Appl. No.: 14/394,040

(22) PCT Filed: Apr. 9, 2013

(86) PCT No.: PCT/CN2013/073917
§ 371 (c)(1),
(2) Date: Oct. 13, 2014

(87) PCT Pub. No.: WO2013/152705
PCT Pub. Date: Oct. 17, 2013

(65) Prior Publication Data

US 2015/0078945 A1 Mar. 19, 2015

(30) Foreign Application Priority Data

Apr. 11, 2012 (CN) ..... 2012 1 0105213
Apr. 11, 2012 (CN) ..... 2012 2 0151455
(Continued)

(51) Int. Cl.
*F16F 15/32* (2006.01)
*G05G 1/00* (2006.01)
(Continued)

(52) U.S. Cl.
CPC ..... *F04C 18/0215* (2013.01); *F04C 23/008* (2013.01); *F04C 29/0021* (2013.01);
(Continued)

(58) Field of Classification Search
CPC ..... F04C 23/008; F04C 29/0021
(Continued)

(56) References Cited

U.S. PATENT DOCUMENTS 4,522,574 A * 6/1985 Arai ..... F01C 21/003 418/151
4,597,724 A 7/1986 Sato et al.
(Continued)

FOREIGN PATENT DOCUMENTS

CN 2688933 Y 3/2005
CN 101297117 A 10/2008
(Continued)

OTHER PUBLICATIONS

Third Chinese Office Action regarding Application No. 201310045737.0 dated Apr. 26, 2016. English translation provided by Unitalen Attorneys at Law.
(Continued)

*Primary Examiner* — Mark Laurenzi
*Assistant Examiner* — Deming Wan
(74) *Attorney, Agent, or Firm* — Harness, Dickey & Pierce, P.L.C.

(57) ABSTRACT

A scroll compressor (10), comprising a fixed scroll (150), a movable scroll (160) and a drive shaft (30); the scroll compressor (10) further comprises a movable scroll counterweight (40); the movable scroll counterweight (40) is configured to rotate with the drive shaft (30); and the centrifugal force of the movable scroll counterweight (40) caused by the rotation acts on the hub (162) of the movable scroll (160). The above structure can effectively reduce the
(Continued)

impact of the centrifugal force of the movable scroll on the radial seal of a scroll component, thus achieving proper radial sealing force between the fixed scroll and the movable scroll at any rotating speed.

30 Claims, 18 Drawing Sheets

(30) Foreign Application Priority Data

Feb. 5, 2013 (CN) ..... 2013 1 0045737
Feb. 5, 2013 (CN) ..... 2013 2 0067054

(51) Int. Cl.

| | |
|---|---|
| ***F01C 1/02*** | (2006.01) |
| ***F01C 1/063*** | (2006.01) |
| ***F03C 2/02*** | (2006.01) |
| ***F04C 2/02*** | (2006.01) |
| ***F04C 18/02*** | (2006.01) |
| ***F04C 23/00*** | (2006.01) |
| ***F04C 29/00*** | (2006.01) |
| ***F04C 29/02*** | (2006.01) |

(52) U.S. Cl.
CPC ..... *F04C 29/023* (2013.01); *F04C 2240/50* (2013.01); *F04C 2240/807* (2013.01)

(58) Field of Classification Search
USPC ..... 418/55.1–55.6, 43, 115, 151; 74/572.4, 74/591; 384/199
See application file for complete search history.

(56) References Cited

U.S. PATENT DOCUMENTS

| | | | | |
|---|---|---|---|---|
| 5,366,359 | A | 11/1994 | Bookbinder et al. | |
| 5,545,019 | A * | 8/1996 | Beck | F04C 18/0215 188/82.1 |
| 6,454,551 | B2 * | 9/2002 | Kuroki | F04C 18/0215 418/151 |
| 8,052,406 | B2 * | 11/2011 | Li | F04C 18/0215 137/454.4 |
| 2007/0092390 | A1 | 4/2007 | Ignatiev et al. | |
| 2007/0231175 | A1 * | 10/2007 | Suefuji | F01C 21/02 418/55.3 |
| 2010/0307173 | A1 | 12/2010 | Guo et al. | |

FOREIGN PATENT DOCUMENTS

| | | | |
|---|---|---|---|
| CN | 201206549 | Y | 3/2009 |
| CN | 101900113 | A | 12/2010 |
| JP | H07133773 | A | 5/1995 |
| JP | H0835493 | A | 2/1996 |
| JP | H06346867 | A | 12/1997 |
| JP | 2002332976 | A | 11/2002 |
| KR | 0147097 | B1 | 8/1998 |

OTHER PUBLICATIONS

Chinese Office Action dated May 7, 2015 regarding Chinese Application No. 201310045737.0. Translation provided by Unitalen Attorneys at Law.
International Search Report for PCT/CN2013/073917 (in English and Chinese), dated Jul. 11, 2013; ISA/CN.

* cited by examiner

SCROLL COMPRESSOR

CROSS REFERENCE OF RELEVANT APPLICATION

This application is the national phase of International Application No. PCT/CN2013/073917, titled "SCROLL COMPRESSOR", filed on Apr. 9, 2013, which claims priority to the Chinese patent application No. 201210105213.1 titled "scroll compressor" and filed with the Chinese Patent Office on Apr. 11, 2012, to the Chinese patent application No. 201220151455.X titled "scroll compressor" and filed with the Chinese Patent Office on Apr. 11, 2012, to the Chinese patent application No. 201310045737.0 titled "scroll compressor" and filed with the Chinese Patent Office on Feb. 5, 2013, and to the Chinese patent application No. 201320067054.0 titled "scroll compressor" and filed with the Chinese Patent Office on Feb. 5, 2013, the disclosures of which are incorporated herein by reference in their entireties.

FIELD

The present application relates to a scroll compressor.

BACKGROUND

The descriptions in this section merely provide background information related to the present disclosure, which may not necessarily constitute the prior art.

As shown in FIG. 1, a conventional scroll compressor 100 generally includes a housing 110, a top cover 112 provided at one end of the housing 110, a bottom cover 114 provided at the other end of the housing 110, and a partition plate 116 which is provided between the top cover 112 and the housing 110 so as to divide an interior space of the compressor into a high-pressure side and a low-pressure side. The high-pressure side is defined between the partition plate 116 and the top cover 112, and the low-pressure side is defined among the partition plate 116, the housing 110 and the bottom cover 114. An inlet 118 for inflowing the fluid is provided on the low-pressure side, and an outlet 119 for discharging the compressed fluid is provided on the high-pressure side. An electric motor 120, including a stator 122 and a rotor 124, is provided in the housing 110. A driving shaft 130 is provided in the rotor 124 to drive a compression mechanism including a fixed scroll 150 and a movable scroll 160. The movable scroll 160 includes an end plate 164, a hub portion 162 formed on one side of the end plate and a spiral wrap 166 formed on the other side of the end plate. The fixed scroll 150 includes an end plate 154, a spiral wrap 156 formed on one side of the end plate and a discharge port 152 formed approximately at the center of the end plate. A series of compression pockets C1, C2 and C3, the volumes of which are reduced from outside to inside in a radial direction, are formed between the spiral wrap 156 of the fixed scroll 150 and the spiral wrap 166 of the movable scroll 160. The radial outermost compression pocket C1 side is at the intake pressure, and the radial innermost compression pocket C3 side is at the discharge pressure. The intermediate compression pocket C2 is between the intake pressure and the discharge pressure, thereby being also called a medium pressure pocket.

The movable scroll 160 is supported at one side by the upper portion of a main bearing housing 140 (which forms a thrust member), and the driving shaft 130 is supported at one end by a main bearing 144 provided in the main bearing housing 140. An eccentric crank pin 132 is provided on one end of the driving shaft 130, and an unloading bushing 142 is provided between the eccentric crank pin 132 and the hub portion 162 of the movable scroll 160. Under the driving of the motor 120, the movable scroll 160 will orbit relative to the fixed scroll 150 (i.e., a central axis of the movable scroll 160 rotates about a central axis of the fixed scroll 150, but the movable scroll 160 does not rotate about its own central axis) to compress fluid. The orbiting is achieved through an Oldham coupling 190 disposed between the fixed scroll 150 and the movable scroll 160. The fluid compressed by the fixed scroll 150 and the movable scroll 160 is discharged to the high-pressure side through the discharge port 152. To prevent the backflow of the fluid at the high-pressure side to the low-pressure side via the discharge port 152 in particular cases, a check valve or discharge valve 170 is provided at the discharge port 152.

To compress fluid, it is necessary to have an effective seal between the fixed scroll 150 and the movable scroll 160. On the one hand, it is necessary to have an axial seal between a top end of the spiral wrap 156 of the fixed scroll 150 and the end plate 164 of the movable scroll 160 and between a top end of the spiral wrap 166 of the movable scroll 160 and the end plate 154 of the fixed scroll 150.

Generally, a backpressure pocket 158 is provided on the side of the end plate 154 of the fixed scroll 150 opposite to the spiral wrap 156. A seal assembly 180 is provided in the backpressure pocket 158, and the partition plate 116 limits an axial displacement of the seal assembly 180. The backpressure pocket 158 is in fluid communication with the intermediate pressure pocket C2 through an axially extending through-hole (not shown) formed in the end plate 154 so as to generate a force for pressing the fixed scroll 150 towards the movable scroll 160. Since the movable scroll 160 is supported at one side by the upper portion of the main bearing housing 140, the pressure in the backpressure pocket 158 may be applied to effectively press the fixed scroll 150 and the movable scroll 160 towards each other. When the pressures in various compression pockets exceed a predetermined value, the resultant force generated from the pressures in the compression pockets will larger than the downward pressing force provided in the backpressure pocket 158 so as to allow the fixed scroll 150 to move upwardly. At this time, the fluid in the compression pockets will leak to the low-pressure side for unloading through a gap between the top end of the spiral wrap 156 of the fixed scroll 150 and the end plate 164 of the movable scroll 160 and a gap between the top end of the spiral wrap 166 of the movable scroll 160 and the end plate 154 of the fixed scroll 150, thereby providing an axial flexibility for the scroll compressor.

On the other hand, it is necessary to have a radial seal between a side surface of the spiral wrap 156 of the fixed scroll 150 and a side surface of the spiral wrap 166 of the movable scroll 160. Such radial seal between them is generally achieved by means of a centrifugal force of the movable scroll 160 in operation and a driving force provided by the driving shaft 130. Specifically, in operation, under the driving of the electric motor 120, the movable scroll 160 will orbit relative to the fixed scroll 150 (i.e., a central axis of the movable scroll 160 rotates about a central axis of the fixed scroll 150, but the movable scroll 160 does not rotate about its own central axis), and thus will generate the centrifugal force. Additionally, the eccentric crank pin 132 of the driving shaft 130 may generate a driving force component contributing to achieve the radial seal between the fixed scroll and the movable scroll during rotation. The spiral wrap 166 of the movable scroll 160 will be brought into abutment against the spiral wrap 156 of the fixed scroll 150 by means of the centrifugal force and the driving force component, thereby achieving a radial seal between them. When incompressible materials (such as solid impurities, lubricating oil and liquid refrigerant) enter the compression pocket and get stuck between the spiral wrap 156 and the spiral wrap 166, the spiral wrap 156 and the spiral wrap 166 may temporarily separate from each other in the radial direction to allow foreign matters to pass therethrough, thereby preventing the damage of the spiral wrap 156 or 166. This ability to radially separate provides a radial flexible for the scroll compressor, improving the reliability of the compressor.

However, there are the following problems as a result of the radial seal achieved by the centrifugal force as described above. FIG. 2 shows a schematic view of a radial seal force between a fixed scroll 150 and a movable scroll 160. As shown in FIG. 2, a total radial seal force between the fixed scroll 150 and the movable scroll 160 may be represented by the formula:

$$F_{flank}=F_{IOS}+F_s \text{ Sin } \theta_{eff}-F_{IO}*\text{Sin } \theta-F_{rg} \qquad \text{formula (1)}$$

where $F_{flank}$ is a total radial seal force between the fixed scroll 150 and the movable scroll 160;

$F_{IOS}$ is the centrifugal force of the movable scroll 160;

$F_s$ Sin $\theta_{eff}$ is the driving force component provided by the eccentric crank pin 132, wherein $F_s$ is the total driving force provided by the eccentric crank pin 132, and $\theta_{eff}$ is the effective driving angle of the eccentric crank pin 132;

$F_{IO}$*Sin $\theta$ is the centrifugal force component provided by the Oldham coupling 190, wherein $F_{IO}$ is the total centrifugal force provided by the Oldham coupling 190, $\theta$ is an angle of the movable scroll 160 oriented relative to the fixed scroll 150;

$F_{rg}$ is the radial gas force provided by the fluid in the compression pockets.

As can be seen from the above formula 1, $F_{IOS}$ and $F_{IO}$*Sin $\theta$ are items related to the rotational speed of the driving shaft 130, whereas $F_s$ Sin $\theta_{eff}$ and $F_{rg}$ are items independent of the rotational speed of the driving shaft 130. Thus, the radial seal force $F_{flank}$ is related to the rotational speed of the driving shaft 130. That is, the greater the rotational speed of the driving shaft 130 is, the greater the radial seal force $F_{flank}$ is, and the smaller the rotational speed of the driving shaft 130 is, the smaller the radial seal force $F_{flank}$ is. Therefore, when the scroll compressor 100 is operated at a low rotational speed, the radial seal force $F_{flank}$ between the fixed scroll 150 and the movable scroll 160 may be insufficient, thereby resulting in a reduced efficiency of the compressor, whereas when the scroll compressor 100 is operated at a high rotational speed, the radial seal force $F_{flank}$ between the fixed scroll 150 and the movable scroll 160 may be excessively large, thereby causing an excessive wear of the scroll components.

Therefore, there is a need for a scroll compressor which can ensure a radial seal both at a low speed and at a high speed in operation.

SUMMARY

An object of one or more embodiments of the present application is to provide a scroll compressor which can ensure a radial seal both under low speed condition and under high speed condition.

An another object of one or more embodiments of the present application is to provide a scroll compressor which can ensure a radial seal while having a simple structure.

In order to achieve one or more of the above-mentioned objects, according to one aspect of the present application, there is provided a scroll compressor, including a fixed scroll, a movable scroll and a driving shaft. The fixed scroll includes a fixed scroll end plate and a fixed scroll wrap formed on one side of the fixed scroll end plate. The movable scroll includes a movable scroll end plate, a movable scroll wrap formed on one side of the movable scroll end plate and a hub portion formed on the other side of the movable scroll end plate. The driving shaft includes an eccentric crank pin, and the eccentric crank pin is fitted in the hub portion of the movable scroll for driving the movable scroll. The scroll compressor further includes a movable scroll counterweight. The movable scroll counterweight is configured to be able to rotate with the driving shaft and to generate a centrifugal force by the rotation which acts on the hub portion of the movable scroll.

Preferably, the direction of the centrifugal force of the movable scroll counterweight is substantially opposite to the direction of the centrifugal force of the movable scroll.

Preferably, the centrifugal force of the movable scroll counterweight is arranged to be approximately equal to the centrifugal force of the movable scroll.

Preferably, the movable scroll counterweight comprises a cylindrical portion provided around the hub portion of the movable scroll, and at least a portion of the cylindrical portion contacts an outer side of the hub portion.

Preferably, a bearing is provided in the cylindrical portion of the movable scroll counterweight, and an inner side of the bearing contacts the outer side of the hub portion.

Preferably, the bearing is a rolling bearing or a sliding bearing.

Preferably, a driving portion for driving the rotation of the movable scroll counterweight is provided on an outer peripheral surface of the driving shaft. The movable scroll counterweight includes a bottom wall, and a driving hole for being fitted with the driving portion is provided in the bottom wall.

Preferably, the driving portion has a shape substantially corresponding to a shape of the driving hole.

Preferably, the driving portion has a non-circular cross-section.

Preferably, a maximum size of the driving portion in a radial direction is less than or equal to a maximum size of the driving hole in the radial direction.

Preferably, the driving portion and the driving hole are configured to allow the movable scroll counterweight to slide on the driving portion in the radial direction.

Preferably, the driving portion includes two step portions each including a bottom surface and a side surface, and the side surfaces of the two step portions are parallel to one another.

Preferably, the driving hole has two side walls able to be fitted with the side surfaces of the two step portions.

Preferably, the two side walls of the driving hole are parallel to one another.

Preferably, wherein the side surfaces of the step portions are substantially parallel to the direction of the centrifugal force of the movable scroll.

Preferably, a distance between the side surfaces of two step portions is substantially equal to a distance between the two side walls of the driving hole of the movable scroll counterweight.

Preferably, the movable scroll counterweight is supported in an axial direction by a bottom surface of at least one of the step portions of the driving shaft.

Preferably, the eccentric crank pin of the driving shaft is fitted in the hub portion of the movable scroll via an unloading bushing. The eccentric crank pin includes a planar portion extending parallel to a rotational axis of the driving shaft, and the unloading bushing includes a planar portion corresponding to the planar portion of the eccentric crank pin.

Preferably, if a gap between the eccentric crank pin and the unloading bushing in the radial direction parallel to the planar portion of the eccentric crank pin is C1, and if a gap between the driving shaft and the driving hole of the movable scroll counterweight in the radial direction parallel to side walls of the driving hole is C2, then the relationship between C1 and C2 is set as $C2 \geq C1$.

Preferably, the center of gravity of the movable scroll counterweight and the center of gravity of the movable scroll are located on opposite sides of the rotational axis of the driving shaft.

Preferably, if the mass of the movable scroll is M1 and the minimum orbiting radius of the movable scroll is D1, and if the mass of the movable scroll counterweight is M2 and the maximum orbiting radius of the centroid of said movable scroll counterweight is D2, then the parameters described above are set to satisfy the formula: $M1*D1 \geq M2*D2$.

Preferably, if a distance between the center of gravity of the movable scroll and the rotational axis of the driving shaft is d1 during a normal operation of the scroll compressor, then $D1=d1-C1$; and if a distance between the center of gravity of the movable scroll counterweight and the rotational axis of the driving shaft is d2 during a normal operation of the scroll compressor, then $D2=d2+C1$.

Preferably, a matched hole is provided in the outer peripheral surface of the driving shaft. A driving hole is formed in the bottom wall of the movable scroll counterweight. The scroll compressor further includes a driving rod having a first end fitted in the matched hole of the driving shaft and a second end fitted in the driving hole of the movable scroll counterweight.

Preferably, the scroll compressor further includes a snap spring allowing the movable scroll counterweight to be fixedly fitted in the hub portion of the movable scroll.

Preferably, the driving hole is an elongated hole substantially extending in the radial direction of the movable scroll counterweight.

Preferably, if a gap between the eccentric crank pin and the unloading bushing in a radial direction parallel to the planar portion of the eccentric crank pin is C1, and if a radial length of the elongated hole is C3, then the relationship between C1 and C3 is set as $C3 \geq C1$.

Preferably, the driving rod is substantially L-shaped.

Preferably, the scroll compressor further includes a main bearing housing for supporting the driving shaft and a thrust plate for supporting the end plate of the movable scroll. The main bearing housing and the thrust plate are separate components and fixed together by a fastening device.

Preferably, a space for rotation of the movable scroll counterweight is formed between the main bearing housing and the thrust plate.

Preferably, the scroll compressor further includes a main bearing housing for supporting the driving shaft and a thrust plate for supporting the end plate of the movable scroll. The main bearing housing and the thrust plate are integrally formed.

Preferably, the movable scroll counterweight includes a cylindrical portion disposed around the hub portion of the movable scroll, and at least one oil supply groove is provided on an inner circumference of the cylindrical portion.

Preferably, the oil supply groove substantially extends in the axial direction of the scroll compressor.

Preferably, a pair of the oil supply grooves are provided.

Preferably, the pair of the oil supply grooves are arranged substantially symmetrically with respect to the rotation center of the movable scroll counterweight.

Preferably, a portion, in which the oil supply groove is provided, of the cylindrical portion of the movable scroll counterweight is higher than the other portions of the cylindrical portion.

Preferably, a portion, in which the oil supply groove is provided, of the cylindrical portion of the movable scroll counterweight is configured to be adjacent to a lower surface of the movable scroll end plate.

Preferably, the movable scroll counterweight further includes a bottom wall, and the bottom wall is formed thereon with a step portion protruding from the bottom wall.

Preferably, the oil supply groove extends to the step portion in the axial direction.

Preferably, the height of the step portion protruded relative to the bottom wall is set such that a ratio of the lubricant flowing upwardly through the oil supply groove to the lubricant flowing downwardly through a driving hole formed in the bottom wall can reach a predetermined value.

The scroll compressor according to one or more embodiments of the present application has following advantageous.

In a scroll compressor according to an embodiment of the present application, a movable scroll counterweight is provided, and configured to be able to rotate with the driving shaft and to generate the centrifugal force under the rotation which acts on the hub portion of the movable scroll. In addition, the direction of the centrifugal force of the movable scroll counterweight may be set to be substantially opposite to the direction of the centrifugal force of the movable scroll. Accordingly, the centrifugal force of the movable scroll can be balanced by the centrifugal force of the movable scroll counterweight. Thus, a radial seal force between the movable scroll and the fixed scroll will depend primarily on a driving force provided by the eccentric crank pin of the driving shaft. Since the driving force provided by the eccentric crank pin is independent of the rotational speed of the driving shaft, by presetting the driving force of the eccentric crank pin to be a proper value, a radial sealing force between the two scroll components can be maintained properly whether the scroll compressor is running at a low speed or running at a high speed.

In a scroll compressor according to an embodiment of the present application, the centrifugal force of the movable scroll counterweight may be set substantially equal to the centrifugal force of the movable scroll. Accordingly, the centrifugal force of the movable scroll can be completely counteracted by the movable scroll counterweight. Thus, it is possible to ensure that a radial sealing force between the two scroll components remains substantially constant at various rotational speeds, so that the scroll compressor can operate stably under various conditions.

In a scroll compressor according to an embodiment of the present application, the movable scroll counterweight can include a cylindrical portion disposed to surround the hub portion of the movable scroll, and at least a portion of the cylindrical portion contacts an outer side of the hub portion. With this construction, the counterweight mechanism is easier to be manufactured and installed, thus enabling to simplify the structure of a scroll compressor and to reduce its manufacturing cost.

In a scroll compressor according to an embodiment of the present application, the cylindrical portion of the movable scroll counterweight may be provided therein with a bearing, and an inner side of the bearing contacts the outer side of the hub portion. Preferably, the bearing may be a rolling bearing or a sliding bearing. With this construction, it is possible to make the transmission of the force between the movable scroll counterweight and the hub portion of the movable scroll smoother, and it is possible to reduce wear therebetween.

In a scroll compressor according to an embodiment of the present application, a driving portion for driving the movable scroll counterweight to rotate is provided on the outer peripheral surface of the driving shaft, and the movable scroll counterweight includes a bottom wall that is provided therein with a driving hole fitted with the driving portion. Thus, the driving shaft can easily drive the movable scroll counterweight to rotate together. Preferably, the driving portion may have a shape substantially corresponding to the shape of the driving hole, for example, the driving portion may have a non-circular cross-section. In practice, the driving portion and the driving hole may be of any construction that enables the cooperation therebetween to perform the power transmission.

In a scroll compressor according to an embodiment of the present application, the maximum size of the driving portion in radial direction may be set to be equal to or smaller than the maximum size of the driving hole in the radial direction. In particular, the driving portion and the driving hole are configured to allow the movable scroll counterweight to slide on the driving portion in the radial direction. Thus, in the case where the centrifugal force of the fixed scroll is counteracted, a radial flexibility still can be provided for the compressor.

In a scroll compressor according to an embodiment of the present application, the driving portion includes two step portions each including a bottom surface and a side surface, and the side surfaces of the two step portions are parallel to one another. Further, the driving hole has two side walls able to be fitted with the side surfaces of the two step portions. With the above construction, the driving shaft can easily and conveniently drive the movable scroll counterweight to rotate synchronously with the movable scroll so as to stably counteract the centrifugal force of the movable scroll.

In a scroll compressor according to an embodiment of the present application, a side surface of each step portion may be substantially parallel to the direction of the centrifugal force of the movable scroll. Thus, the movable scroll counterweight is to generate the centrifugal force only in the radial direction without a component of the force in other directions, which further simplifies the design of the movable scroll counterweight. Furthermore, a distance between the side surfaces of the two step portions may be substantially equal to a distance between the two side walls of the driving hole of the movable scroll counterweight. Therefore, when the driving shaft starts to rotate or stops rotating, there is no collision between the driving shaft and the movable scroll counterweight, thus avoiding noises to be generated therebetween.

In a scroll compressor according to an embodiment of the present application, the movable scroll counterweight is supported in the axial direction by a bottom surface of at least one of the step portions of the driving shaft. In other words, the movable scroll counterweight can rest directly on the bottom surface of the at least one of the step portions of the driving shaft, without the need for providing other members for holding the movable scroll counterweight axially, thereby simplifying the structure of the counterweight mechanism.

In a scroll compressor according to an embodiment of the present application, the eccentric crank pin of the driving shaft may be fitted in the hub portion of the movable scroll via an unloading bushing. In this case, if a gap between the eccentric crank pin and the unloading bushing in a radial direction parallel to the planar portion of the eccentric crank pin is C1, and if a gap between the driving shaft and the driving hole of the movable scroll counterweight in a radial direction parallel to the side walls of the driving hole is C2, then the relationship between C1 and C2 is set as $C2 \geq C1$. With this construction, it is possible to ensure that the compressor provided with the movable scroll counterweight still has its existing radial flexibility.

In a scroll compressor according to an embodiment of the present application, the center of gravity of the movable scroll counterweight and the center of gravity of the movable scroll can be located at opposite sides of the rotational axis of the driving shaft. In this case, if the mass of the movable scroll is M1 and the minimum orbiting radius of the movable scroll is D1, and if the mass of the movable scroll counterweight is M2 and the maximum orbiting radius of the centroid (or center of mass) of the movable scroll counterweight is D2, the above parameters are set to meet formula: $M1*D1 \geq M2*D2$. If a distance between the center of gravity of the movable scroll and the rotational axis of the driving shaft is d1 in a normal operation process of the scroll compressor, then $D1=d1-C1$. And, if the distance between the center of gravity of the movable scroll counterweight and the rotational axis of the driving shaft is d2 in a normal operation process of the scroll compressor, then $D2=d2+C1$. The above parameters further clarify the relationship between the geometric parameters of the movable scroll counterweight and the movable scroll, thus greatly facilitating the design of the movable scroll counterweight.

In a scroll compressor according to an embodiment of the present application, a matched hole is provided in the outer peripheral surface of the driving shaft, and a driving hole can be formed in the bottom wall of the movable scroll counterweight. The scroll compressor may further include a driving rod having a first end fitted in the matched hole of the driving shaft and a second end fitted in the driving hole of the movable scroll counterweight. With this construction, the driving shaft can easily and conveniently drive the movable scroll counterweight to synchronously rotate with the movable scroll, thereby counteracting stably the centrifugal force of the movable scroll.

In a scroll compressor according to an embodiment of the present application, the scroll compressor may further include a snap spring by which the movable scroll counterweight is fixedly fitted on the hub portion of the movable scroll. Therefore, the structure of the counterweight mechanism is relatively simple, and is assembled easily.

In a scroll compressor according to an embodiment of the present application, the driving hole may be an elongated hole substantially extending in the radial direction of the movable scroll counterweight. In addition, if a gap between the eccentric crank pin and the unloading bushing in a radial direction parallel to the planar portion of the eccentric crank pin is C1, and if a radial length of the elongated hole is C3, then the relationship between C1 and C3 is set as $C3 \geq C1$.

With this construction, it is ensured that the scroll compressor provided with the movable scroll counterweight still has its existing radial flexibility.

In a scroll compressor according to an embodiment of the present application, a space for rotation of the movable scroll counterweight may be formed between the main bearing housing and the thrust plate. In other words, there is only a need for simple modification to the main bearing housing, or there is no need for modification to the main bearing housing (for example, the volume of the movable scroll counterweight is set to be suitable for rotation of the movable scroll counterweight in the existing space of the main bearing housing). Thus, the movable scroll counterweight may simply be configured. In addition, the main bearing housing and the thrust plate may be integrally formed, or may be formed as separate components and then be fixed together by a fastening device. With these constructions, the flexibility of the design of the movable scroll counterweight increases. In addition, in the case that the main bearing housing and the thrust plate are separate components, the thrust plate may be designed appropriately such as to provide the movable scroll with a thrust surface having a greater area, so as to increase the stability and durability of the operation of the scroll compressor.

In a scroll compressor according to an embodiment of the present application, at least one oil supply groove is provided on an inner circumference of the cylindrical portion of the movable scroll counterweight. Lubricant can be easily and reliably supplied onto the thrust surfaces between the end plate of the movable scroll and the thrust plate through the oil supply groove, so as to achieve a better lubrication. In addition, the portion of the cylindrical portion in which the oil supply groove is provided may be higher than the other portions of the cylindrical portion, or the portion of the cylindrical portion in which the oil supply groove is provided can be constructed to be adjacent to a lower surface of the end plate of the movable scroll, thereby facilitating the supply of lubricant to the thrust surface of the movable scroll with ease. Further, a step portion may be formed at the bottom wall of the movable scroll counterweight. A ratio of the lubricant flowing upwardly through the oil supply grooves to the lubricant flowing downwardly through the driving hole formed in the bottom wall can be controlled by using the step portion, so as to realize a reasonable supply of the lubricant to various parts that need be lubricated.

BRIEF DESCRIPTION OF THE DRAWINGS

The features and advantages of one or more embodiments of the present application will become more apparent from the following description with reference to the accompanying drawings, wherein.

DETAILED DESCRIPTION

Figure 1:
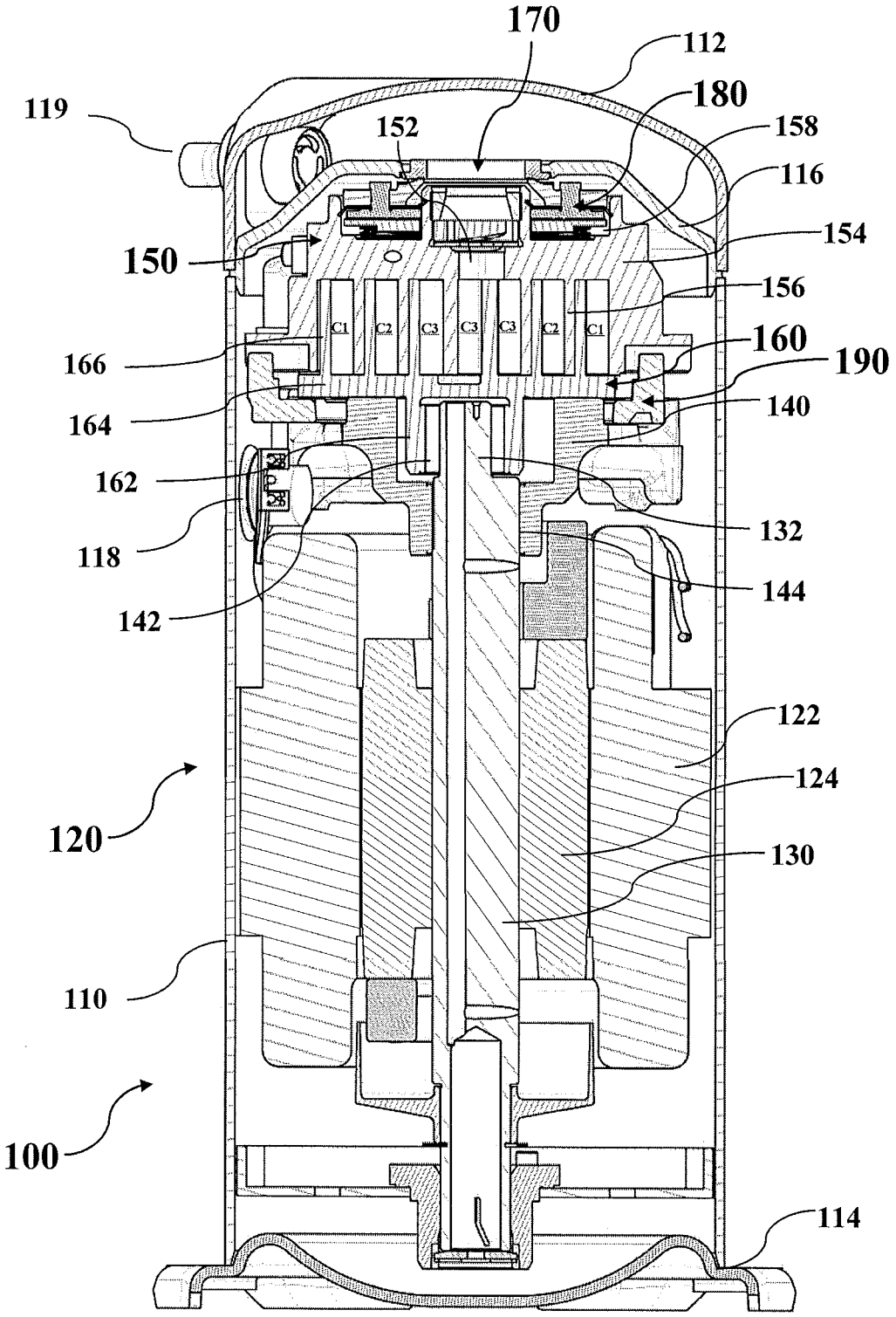
FIG. 1 is a longitudinal sectional view of a conventional scroll compressor.
Figure 2:
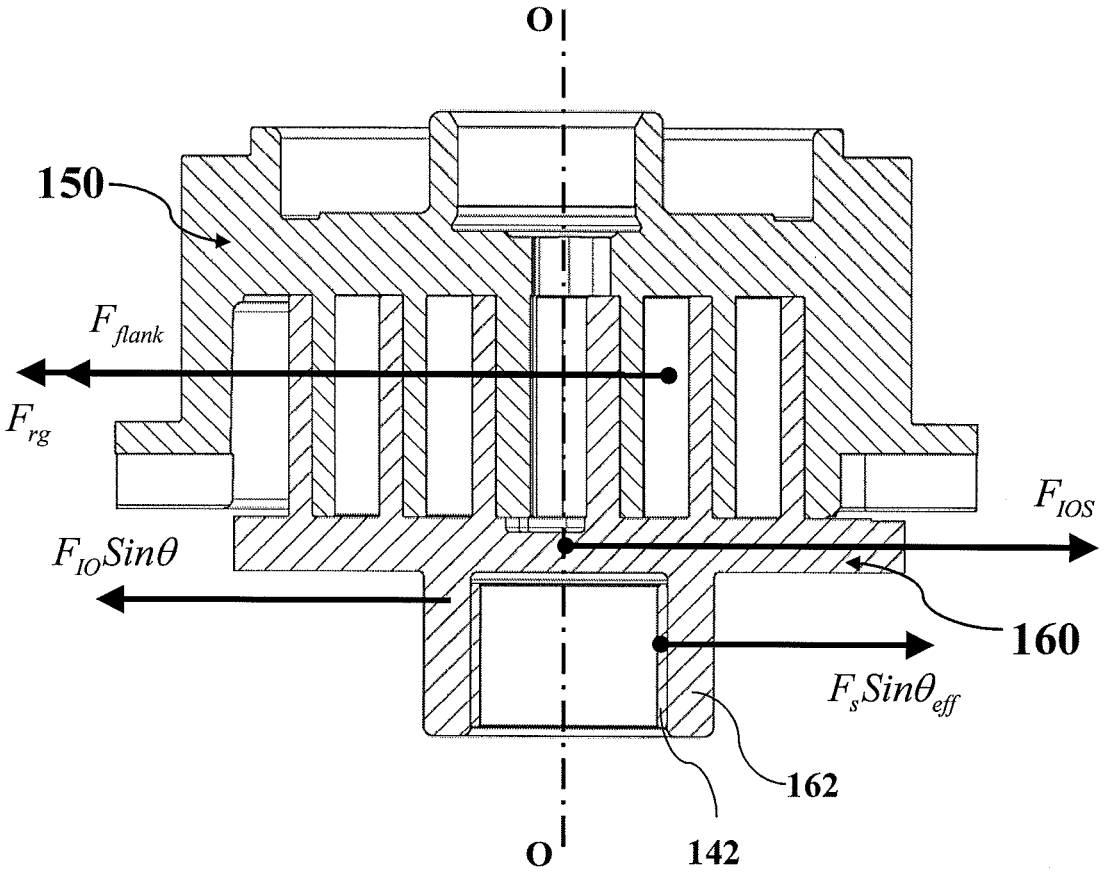
FIG. 2 is a schematic view of a radial seal force between a movable scroll and a fixed scroll of FIG. 1.

The following description of preferred embodiments is only exemplary, and is never a limitation to the present application and its application or usage.

An identical reference numeral is adopted to represent an identical component throughout the accompanying drawings. Therefore, the constructions of the same components will no longer be repeated in this description.

The basic structure and principle of a scroll compressor 10 according to the first embodiment of the application will be described below with reference to FIG. 3-13.

Figure 3:
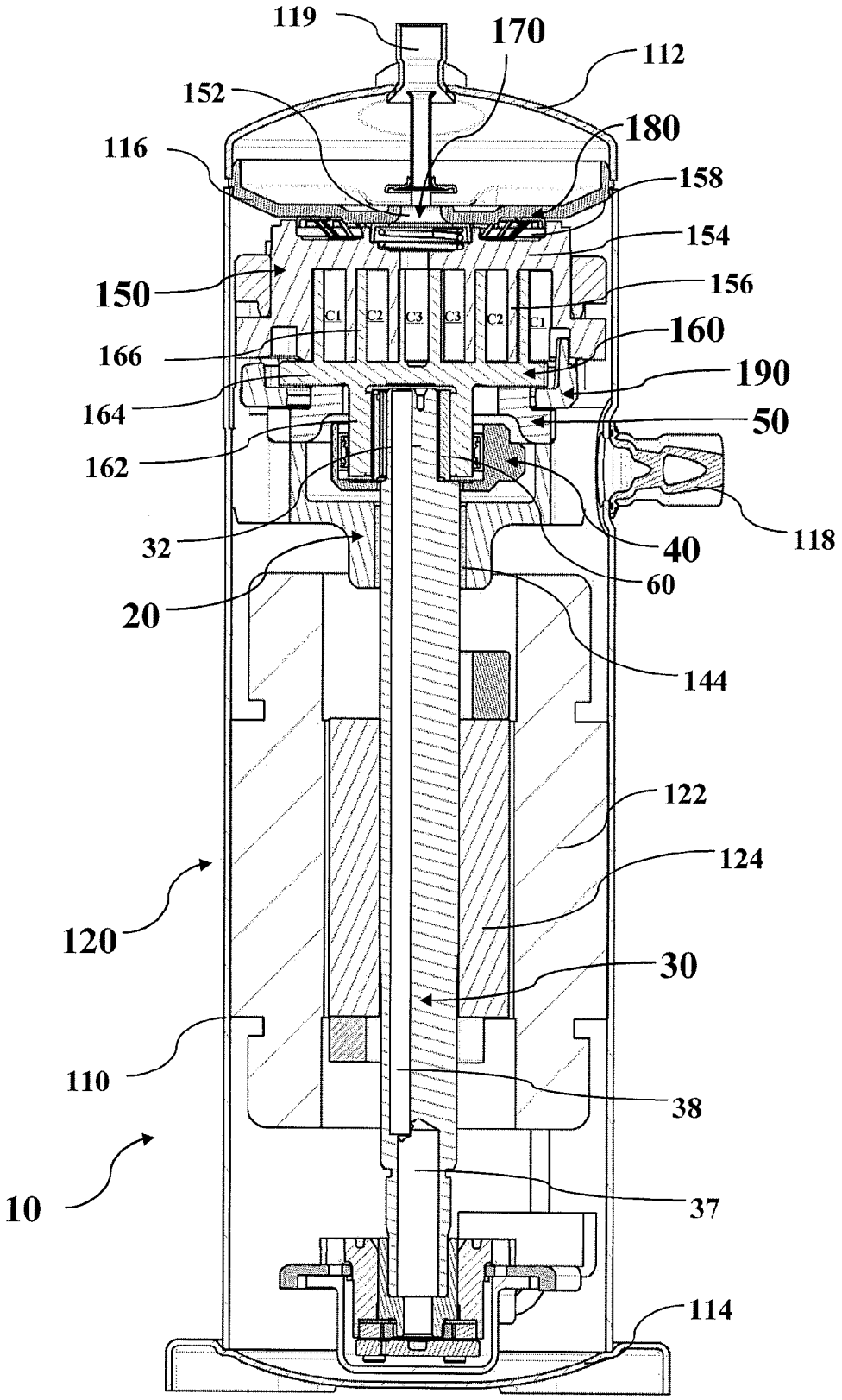
FIG. 3 shows a longitudinal sectional view of a scroll compressor according to a first embodiment of the application.
Figure 4:
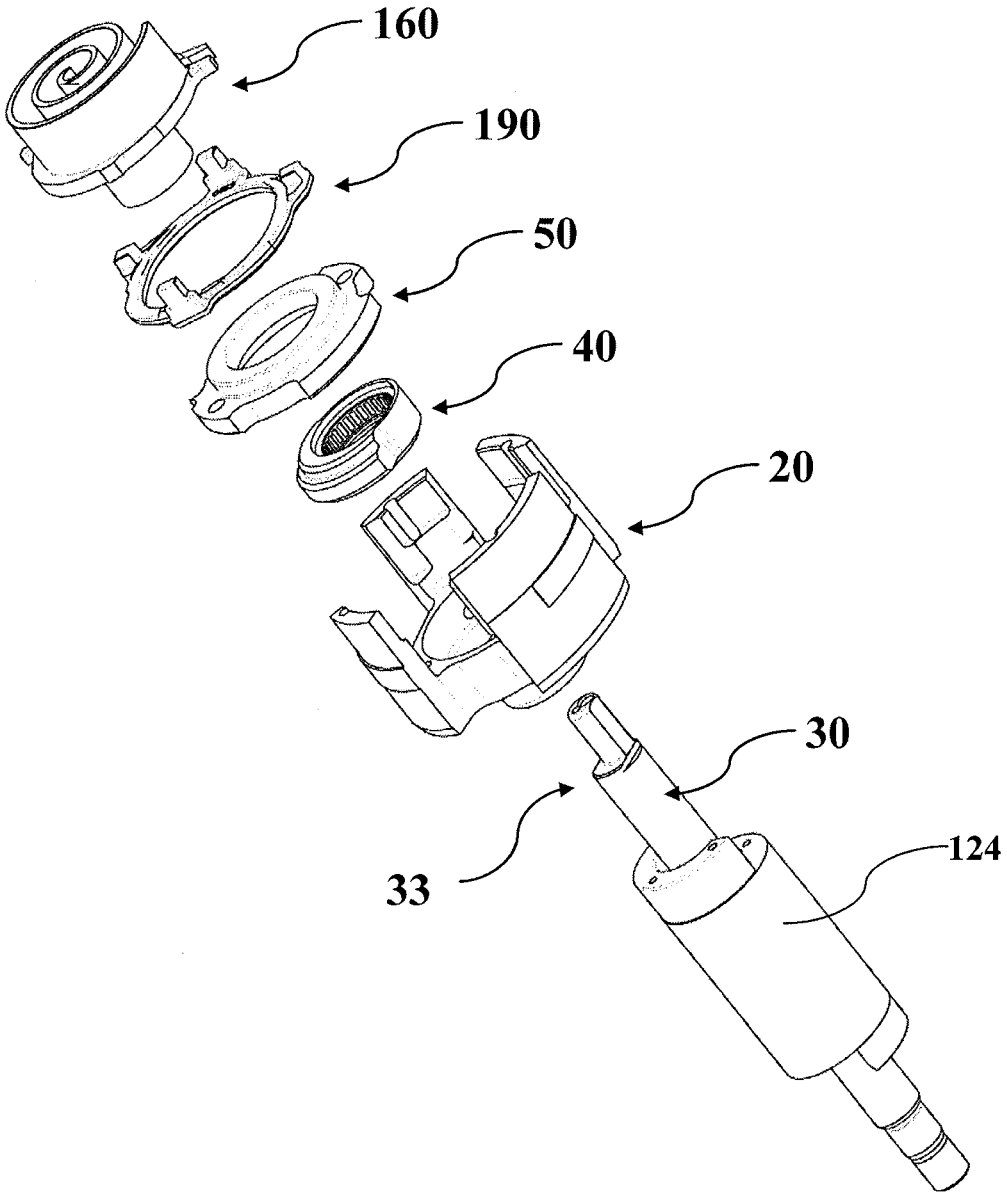
FIG. 4 shows an exploded perspective view of associated components surrounding a movable scroll counterweight according to the first embodiment of the application.
Figure 5:
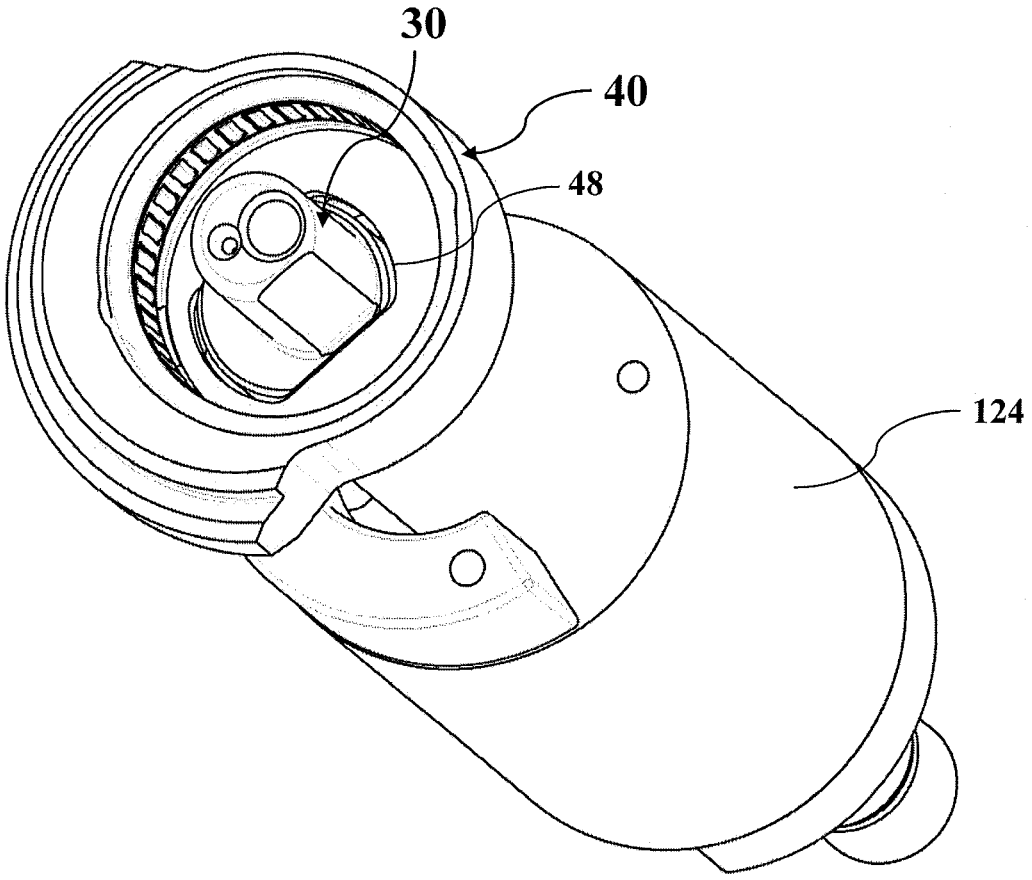
FIG. 5 shows an assembled perspective view of the components shown in FIG. 4.

As shown in FIG. 3, the scroll compressor 10 according to an embodiment of the present application generally includes a housing 110, a top cover 112 arranged at one end of the housing 110, a bottom cover 114 arranged on the other end of the housing 110, and a partition plate 116 arranged between the top cover 112 and the housing 110 to divide an inner space of the compressor into a high-pressure side and a low-pressure side. The high-pressure side is defined between the partition plate 116 and the top cover 112, and the low-pressure side is defined among the partition plate 116, the housing 110 and the bottom cover 114. An inlet 118 for inflowing the fluid is provided on the low-pressure side, and an outlet 119 for discharging the compressed fluid is provided on the high-pressure side. An electric motor 120, including a stator 122 and a rotor 124, is provided in the housing 110. A driving shaft 130 is provided in the rotor 124 to drive a compression mechanism including a fixed scroll 150 and a movable scroll 160. The movable scroll 160 includes an end plate 164, a hub portion 162 formed on one side of the end plate and a spiral wrap 166 formed on the other side of the end plate. The fixed scroll 150 includes an end plate 154, a spiral wrap 156 formed on one side of the end plate and an discharge port 152 formed approximately at the center of the end plate.

A series of compression pockets C1, C2 and C3, the volumes of which are reduced from outside to inside in a radial direction, are formed between the spiral wrap 156 of the fixed scroll 150 and the spiral wrap 166 of the movable scroll 160. The radial outermost compression pocket C1 is at the intake pressure, and the radial innermost compression pocket C3 is at the discharge pressure. The intermediate compression pocket C2 is between the intake pressure and the discharge pressure, thereby being also called medium pressure pocket.

Figure 11:
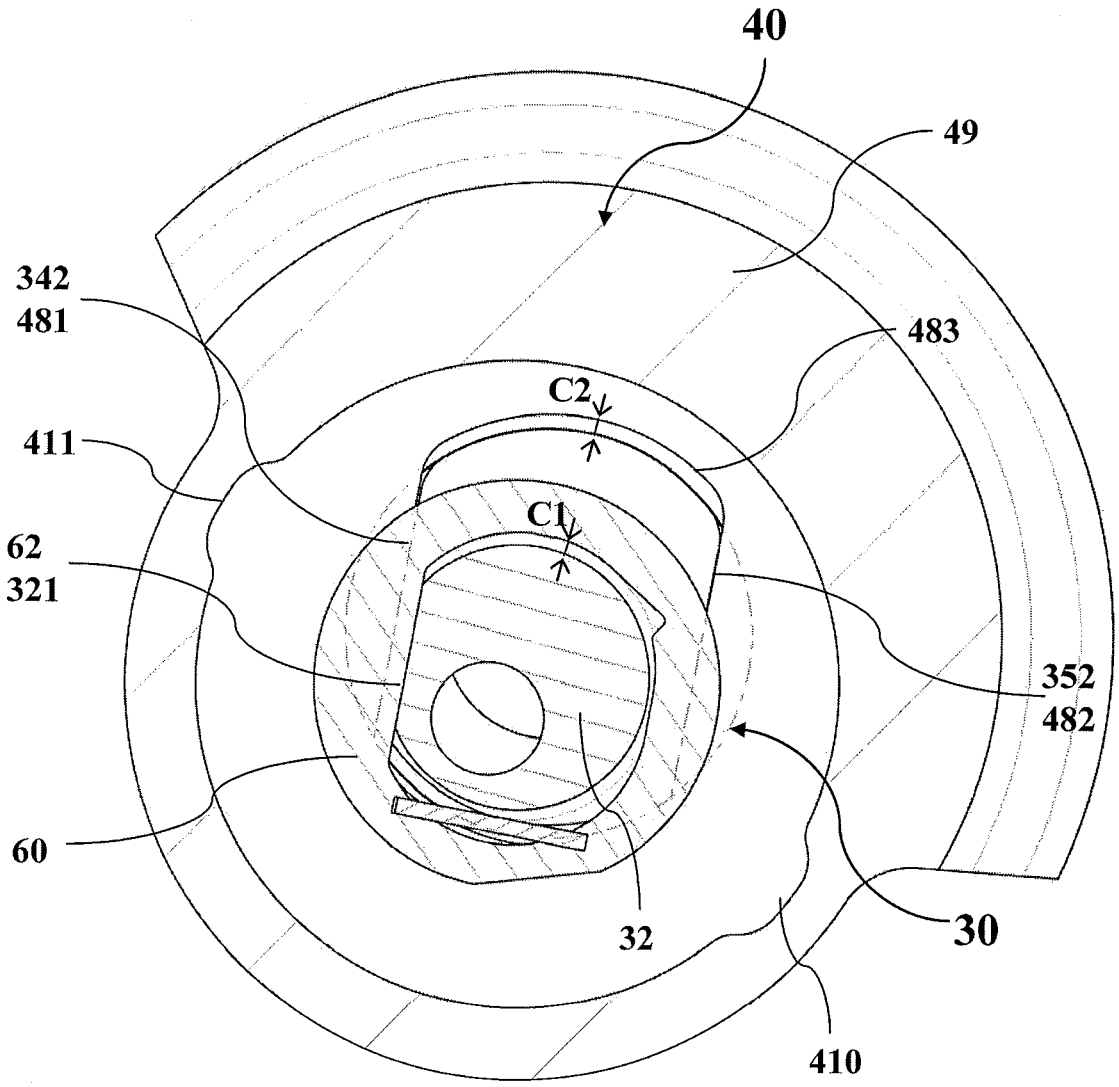
FIG. 11 is a partial enlarged view of FIG. 10 showing the relationship among a driving shaft, a movable scroll counterweight and an unloading bushing.

A portion of the driving shaft 30 is supported by a main bearing 144 arranged in a main bearing housing 20. One end of driving shaft 30 is formed with an eccentric crank pin 32. The eccentric crank pin 32 is fitted in a hub portion 162 of the movable scroll 160 via an unloading bushing 60 so as to drive the movable scroll 160. As shown in FIG. 11, the eccentric crank pin 32 includes a planar portion 321 extending in parallel to the rotational axis of the driving shaft 30, and the unloading bushing 60 includes a planar portion 62 corresponding to the planar portion 321 of the eccentric crank pin.

A thrust plate 50 is provided on the main bearing housing 20. The thrust plate 50 can be fixed on the main bearing housing 20 by a fastening device (referring to FIGS. 8A and 8B). A space S is formed between the main bearing housing 20 and the thrust plate 50. The movable scroll 160 is supported at one side by the thrust plate 50. Under the driving of the electric motor 120, the movable scroll 160 will orbit with respect to the fixed scroll 150 (i.e., the central axis of the movable scroll 160 rotates around the central axis of the fixed scroll 150, but the movable scroll 160 cannot rotate around its own central axis) to compress fluid. The orbiting is realized by the Oldham coupling 190 arranged between the fixed scroll 150 and the movable scroll 160. The fluid compressed by the fixed scroll 150 and the movable scroll 160 is discharged to the high-pressure side through the discharge port 152. To prevent the backflow of the fluid at the high-pressure side to the low-pressure side via the discharge port 152 in particular cases, a check valve or discharge valve 170 is provided at the discharge port 152.

To achieve an axial seal between a top end of the spiral wrap 156 of the fixed scroll 150 and the end plate 164 of the movable scroll 160 and an axial seal between a top end of the spiral wrap 166 of the movable scroll 160 and the end plate 154 of the fixed scroll 150. Generally, a backpressure pocket 158 is provided on a side of the end plate 154 of the fixed scroll 150 opposite to the spiral wrap 156. A seal assembly 180 is provided in the backpressure pocket 158, and an axial displacement of the seal assembly 180 is limited by the partition plate 116. The backpressure pocket 158 is in fluid communication with the intermediate pressure pocket C2 through an axially extending through-hole (not shown) formed in the end plate 154 so as to generate a force for pressing the fixed scroll 150 towards the movable scroll 160. Since the movable scroll 160 is supported on one side by an upper portion of the main bearing housing 140, the pressure in the backpressure pocket 158 may be employed to effectively press the fixed scroll 150 and the movable scroll 160 towards each other. When the pressures in various compression pockets exceed a predetermined value, the resultant force generated from the pressures in the compression pockets will larger than the downward pressing force provided in the backpressure pocket 158 so as to allow the fixed scroll 150 to move upwardly. At this time, the fluid in the compression pockets will leak to the low-pressure side for unloading, through a gap between the top end of the spiral wrap 156 of the fixed scroll 150 and the end plate 164 of the movable scroll 160 and a gap between the top end of the spiral wrap 166 of the movable scroll 160 and the end plate 154 of the fixed scroll 150, thereby providing an axial flexibility for the scroll compressor.

On the other hand, in order to achieve a radial seal between a side surface of the spiral wrap 156 of the fixed scroll 150 and a side surface of the spiral wrap 166 of the movable scroll 160, and in order to maintain such radial seal between them at a suitable value both in a high rotational speed condition and in a low rotational speed condition, a movable scroll counterweight 40 is further provided in the scroll compressor 10 according to the first embodiment of the application. The movable scroll counterweight 40 is configured to rotate with the driving shaft 30 and generate the centrifugal force due to the rotation to act on the hub portion 162 of the movable scroll 160.

Preferably, the direction of the centrifugal force of the movable scroll counterweight 40 can be set to substantially be opposite to the direction of the centrifugal force of the movable scroll 160. Accordingly, the movable scroll counterweight can most effectively counteract the centrifugal force of the movable scroll 160. Further, the centrifugal force of the movable scroll counterweight 40 may be set to be approximately equal to the centrifugal force of the movable scroll 160. In this case, the centrifugal force of the movable scroll 160 can completely be counteracted by the movable scroll counterweight 40. However, the skilled person in the art should understand that the centrifugal force of the movable scroll counterweight 40 may also be set to be different from the centrifugal force of the movable scroll 160. In this case, the centrifugal force of the movable scroll 160 will at least partially counteracted by the centrifugal force of the movable scroll counterweight 40. Therefore, the difference between the radial sealing force between the scroll components under the high rotational speed condition and under the rotational low speed condition can also be reduced, thereby avoiding an improper sealing under the low rotational speed condition and an excessive wear under the high rotational speed condition.

Figure 7A:
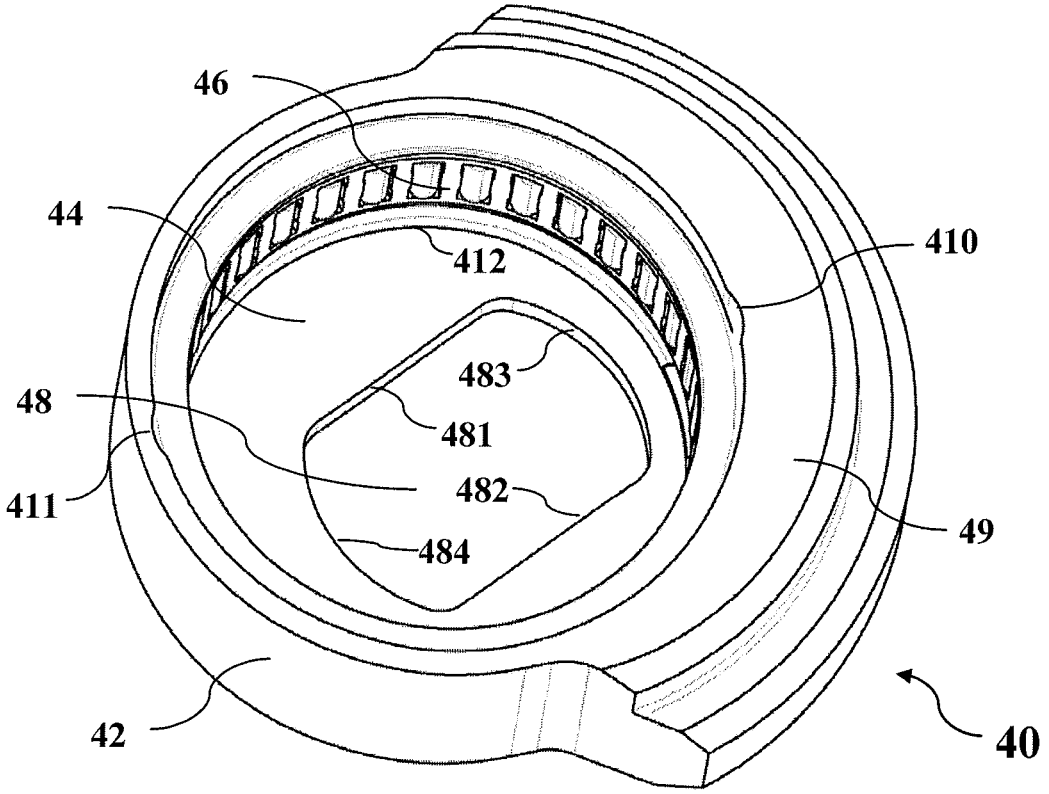
FIG. 7A is a perspective view of a movable scroll counterweight according to the first embodiment of the application.
Figure 7B:
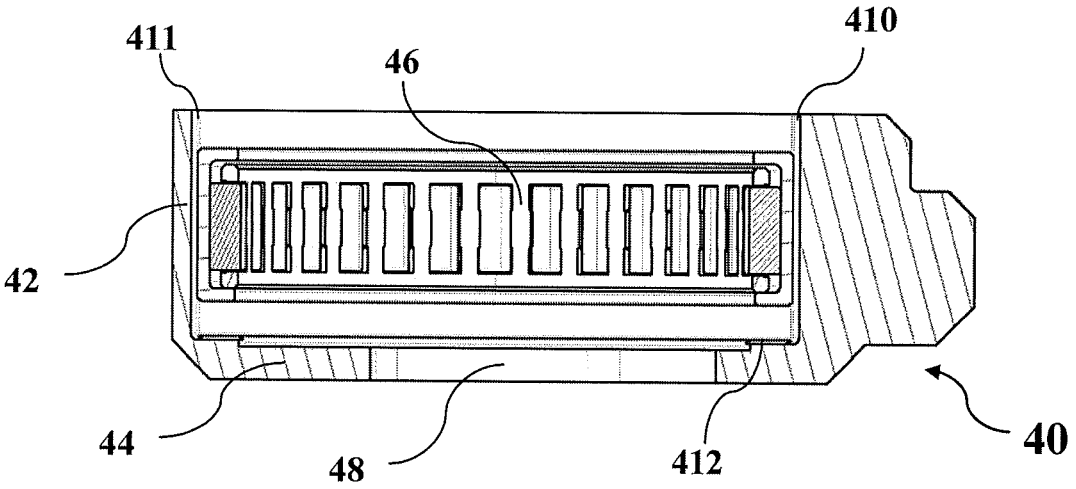
FIG. 7B is a longitudinal sectional view of the movable scroll counterweight.
Figure 8A:
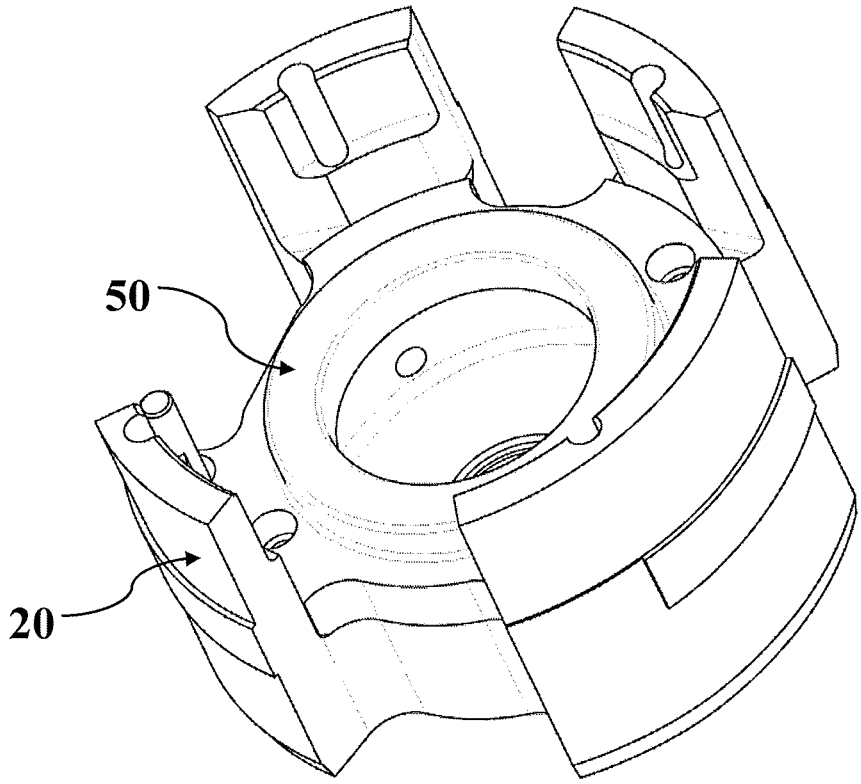
FIG. 8A is a perspective view of a main bearing housing and a thrust plate according to the first embodiment of the application.
Figure 8B:
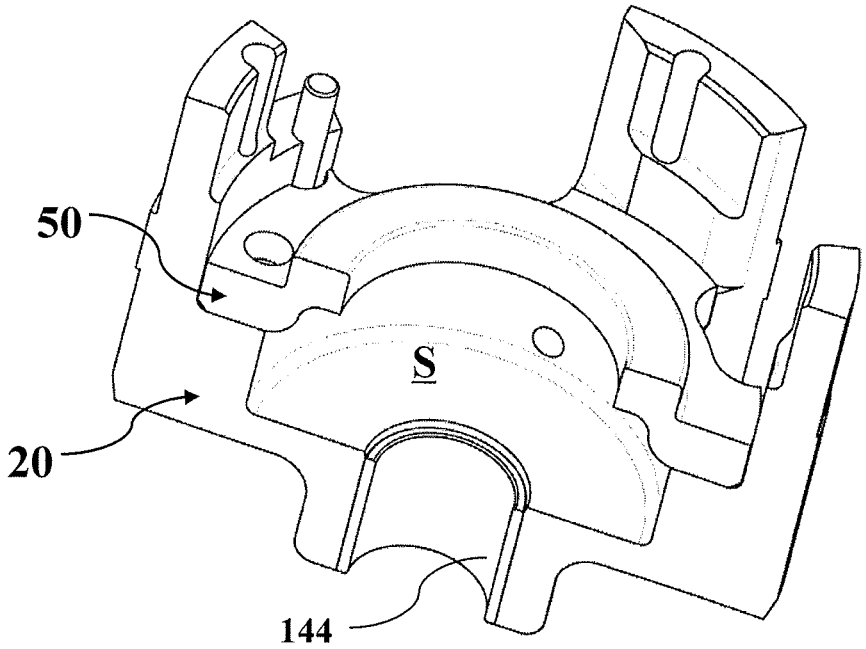
FIG. 8B is a partial sectional perspective view of the main bearing housing and the thrust plate.
Figure 9:
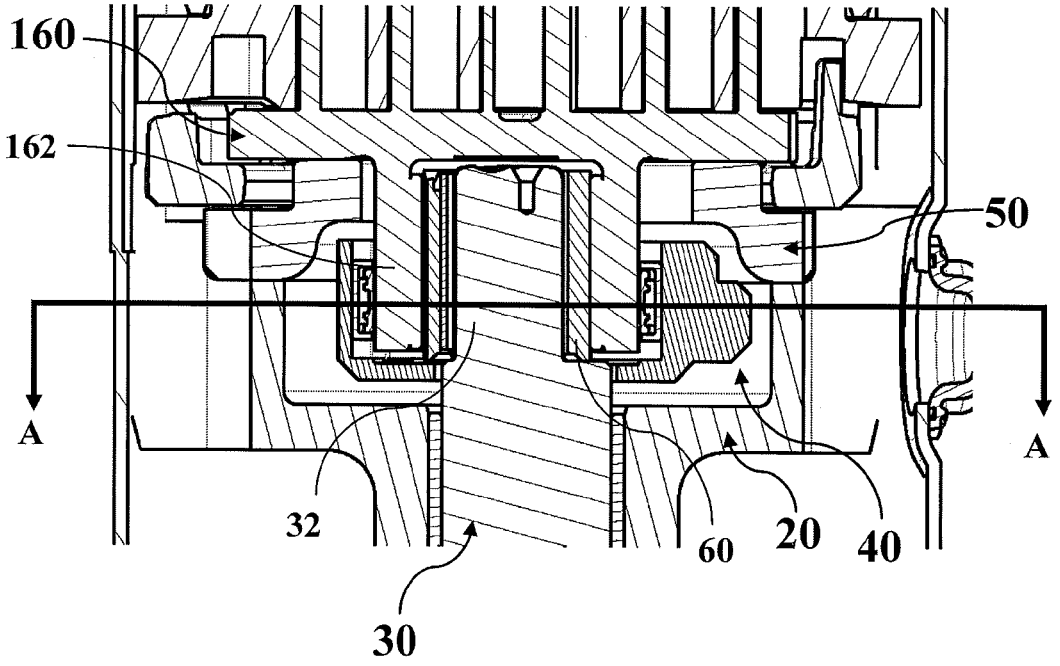
FIG. 9 is an enlarged longitudinal sectional view of surroundings of the movable scroll counterweight according to the first embodiment of the application.
Figure 10:
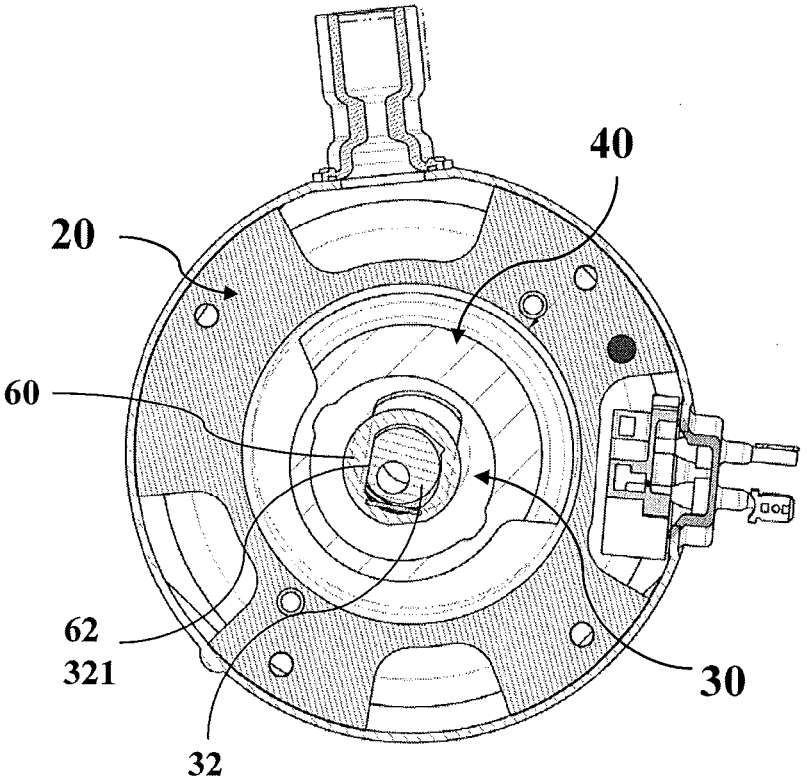
FIG. 10 is a plan sectional view taken along line A-A shown in FIG. 9.

Specifically, as shown in FIGS. 3, 7A and 7B, the movable scroll counterweight 40 may include a cylindrical portion 42 disposed to surround the hub portion 162 of the movable scroll 160. A bearing 46 is provided in the cylindrical portion 42 of the movable scroll counterweight 40, and an inner side of the bearing 46 contacts an outer side of the hub portion 162. The bearing 46 may be a rolling bearing or a sliding bearing or any other suitable bearing. The bearing 46 contributes to the transmission of force between the movable scroll counterweight 40 and the hub portion 162 of the movable scroll 160 and contributes to reducing wears therebetween. However, those skilled in the art will understand that the bearing 46 may also be omitted as a modification shown in FIGS. 14, 15A and 15B. Then, the movable scroll counterweight 40 may be provided such that at least a portion of its cylindrical portion 42 contacts the outer side of the hub portion 162.

As shown in FIGS. 4, 6A, 6B and 6C, a driving portion 33 may be provided on an outer peripheral surface of the driving shaft 30 for driving the movable scroll counterweight 40 to rotate. As shown in FIGS. 7A and 7B, the movable scroll counterweight 40 may include a bottom wall 44, and a driving hole 48 fitted with the driving portion 33 may be provided on the bottom wall 44. The shape of the driving portion 33 may be set to substantially correspond to the shape of the driving hole 48. Irrespective of providing a radial flexibility for the compressor, the driving portion 33 may have any non-circular cross-section for driving the movable scroll counterweight 40. In practice, the driving portion 33 and the driving hole 48 may be of any construction that allows them to be fitted with each another so as to perform the transmission of power.

In consideration of providing a radial flexibility for the compressor, the maximum size of the driving portion 33 in the radial direction may be set to be equal to or less than the maximum size of the driving hole 48 in the radial direction. Further, the driving portion 33 and the driving hole 48 may be configured such as to allow the movable scroll counterweight 40 to slide on the driving portion 33 in the radial direction.

Figure 6A:
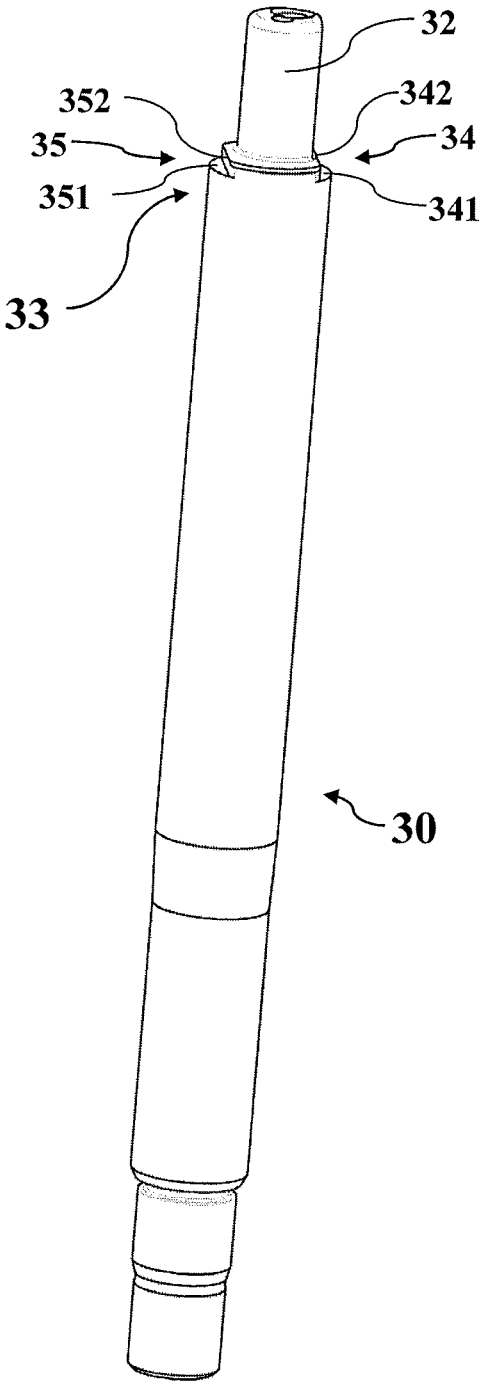
FIG. 6A is a perspective view of a driving shaft according to the first embodiment of the application.
Figure 6B:
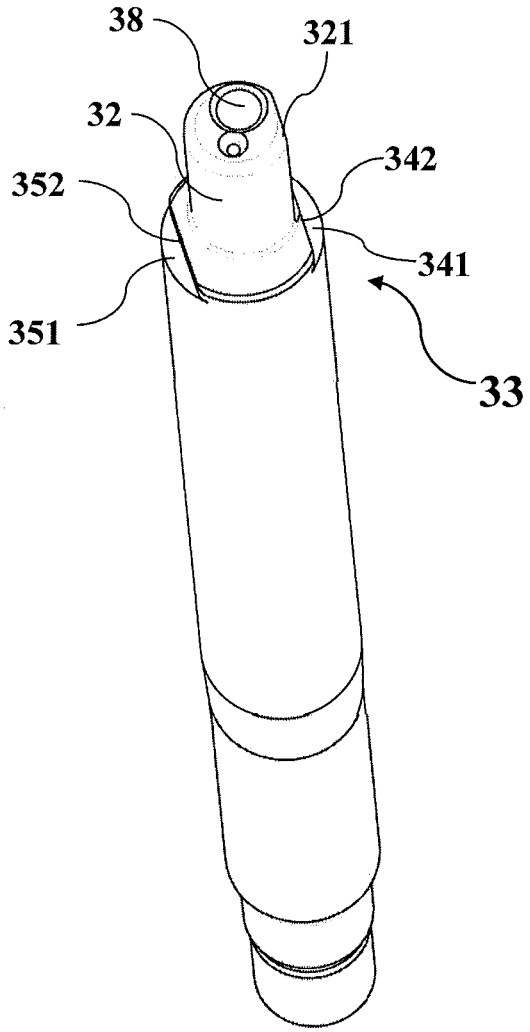
FIG. 6B is another perspective view of the driving shaft.
Figure 6C:
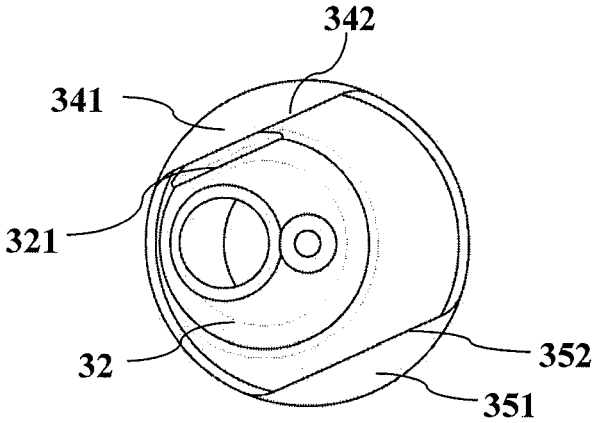
FIG. 6C is an end view of the driving shaft.

More specifically, as shown in FIGS. 6A, 6B and 6C, the driving portion 33 may include two step portions 34 and 35. The step portions 34, 35 include respective bottom surfaces 341, 351 and respective side surfaces 342, 352. The side surfaces 342, 352 of the two step portions 34, 35 are parallel to each other. As shown in FIGS. 7A and 7B, a driving hole 48 is formed in the bottom wall 44 of the movable scroll counterweight 40, and has two side walls 481, 482 fitted with the side surfaces 342, 352 of the two step portions 34, 35. The driving hole 48 also has two arc side walls 483, 484 respectively connected to the two side walls 481, 482. Preferably, the two side walls 481, 482 of the driving hole 48 are provided in parallel to each other.

The respective side surfaces 342, 352 of the step portions 34, 35 may be configured to be substantially parallel to the direction of the centrifugal force of the movable scroll 160. A distance between the side surfaces 342, 352 of the two step portions 34, 35 may be set to be approximately equal to a distance between the two side walls 481, 482 of the driving hole 48 of the movable scroll counterweight 40. The movable scroll counterweight 40 is supported in the axial direction by the bottom surface 341, 351 of at least one of the step portions 34, 35 of the driving shaft 30.

Further, as shown in FIG. 11, a gap between the eccentric crank pin 32 and the unloading bushing 60 in the radial direction parallel to the planar portion 321 of the eccentric crank pin 32 is indicated as C1, and a gap between the driving shaft 30 and the driving hole 48 of the movable scroll counterweight 40 in the radial direction parallel to the side walls 481, 482 of the driving hole 48 is indicated as C2. Then, the relationship between C1 and C2 may be set as C2≥C1. It will be appreciated by those skilled in the art that the gap C1 is a total gap between the eccentric crank pin 32 and the unloading bushing 60 in the radial direction, and the gap C2 is a total gap between the driving shaft 30 and the driving hole 48 of the movable scroll counterweight 40 in the radial direction.

With the above construction, when the driving shaft 30 drives the movable scroll 160 to rotate, the movable scroll counterweight 40 rotates synchronously with the movable scroll 160 by means of the cooperation between the driving hole 48 and the step portions 34, 35. The centrifugal force generated by the movable scroll counterweight 40 will be transmitted to the hub portion 162 of the movable scroll 160 via the cylindrical portion 42 and the bearing 46. Since the movable scroll counterweight 40 is assembled such that the direction of its centrifugal force is substantially opposite to the direction of the centrifugal force of the movable scroll 160, the centrifugal force of the movable scroll counterweight 40 can counteract at least a portion of the centrifugal force of the movable scroll 160. In particular, when the centrifugal force of the movable scroll counterweight 40 is set to be substantially equal to the centrifugal force of the movable scroll 160, the centrifugal force of the movable scroll 160 will be counteracted completely. In this case, whether the rotational speed of the driving shaft 30 is high or low, the radial sealing force between the movable scroll and the fixed scroll is independent of the centrifugal force of the movable scroll 160.

Figure 12:
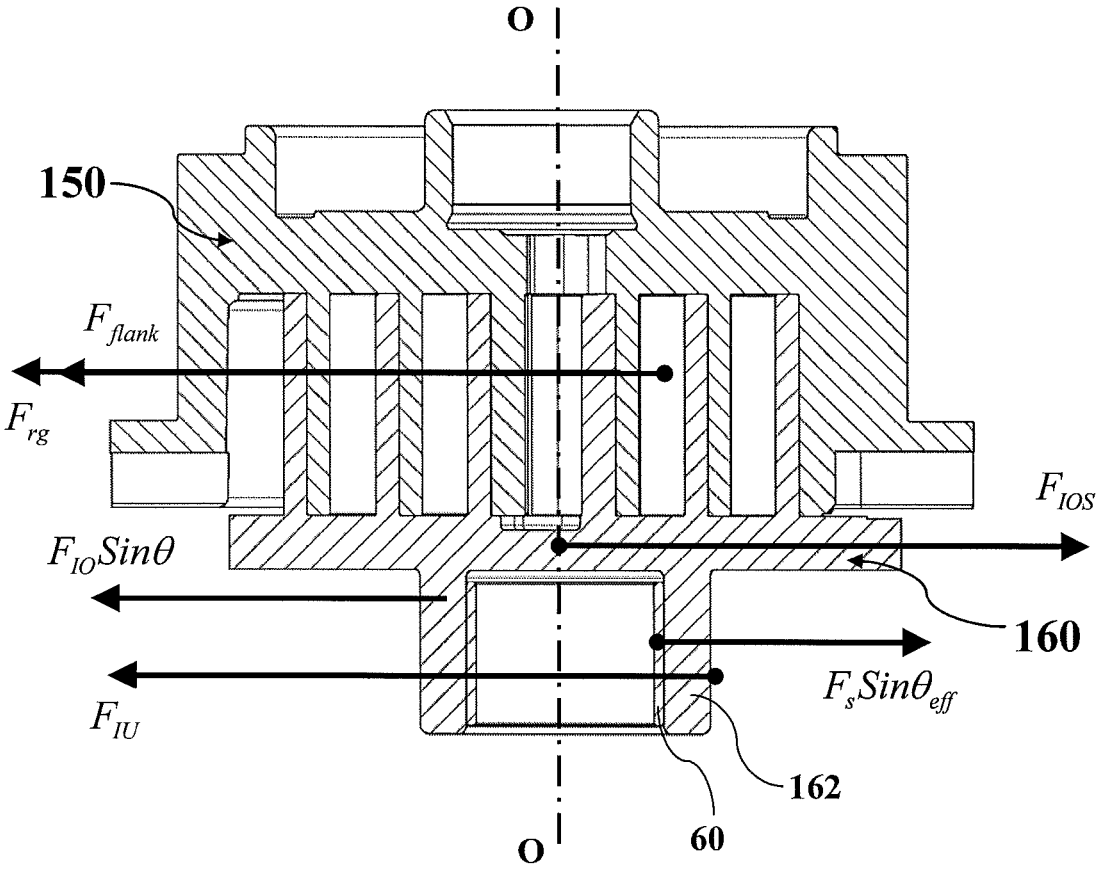
FIG. 12 is a schematic view of a radial seal force between a movable scroll and a fixed scroll according to the first embodiment of the application.

Referring to FIG. 12, specifically, a total radial sealing force between the fixed scroll 150 and the movable scroll 160 of the scroll compressor 10 according to the first embodiment of the present application may be represented by the formula:

$$F_{flank}=F_{IOS}+F_s \sin\theta_{eff}-F_{IO}*\sin\theta-F_{rg}-F_{IU} \quad \text{formula (2)}$$

Where $F_{flank}$ is a total radial sealing force between the fixed scroll 150 and the movable scroll 160;

$F_{IOS}$ is the centrifugal force of the movable scroll 160;

$F_s \sin\theta_{eff}$ is a component of the driving force provided by the eccentric crank pin 32, wherein $F_s$ is the total driving force provided by the eccentric crank pin 32, and $\theta_{eff}$ is the effective driving angle of the eccentric crank pin 32;

$F_{IO}*\sin\theta$ is a component of the centrifugal force provided by the Oldham coupling 190, wherein $F_{IO}$ is the total centrifugal force provided by the Oldham coupling 190, and $\theta$ is a angle of the movable scroll 160 oriented relative to the fixed scroll 150;

$F_{rg}$ is a gas force provided by the fluid in the compression pockets; and $F_{IU}$ is the centrifugal force of the movable scroll counterweight 40.

As can be seen from the above formula 2, while $F_{IOS}$ and $F_{IU}$ are items relating to the rotational speed of the driving shaft, by setting $F_{IU}$ to be substantially equal to $F_{IOS}$, the difference ($F_{IOS}-F_{IU}$) between $F_{IOS}$ and $F_{IU}$ is substantially zero. In particular, regardless of the rotational speed of the driving shaft, the difference ($F_{IOS}-F_{IU}$) between $F_{IOS}$ and $F_{IU}$ is substantially zero. Thus, the above formula 2 can be simplified as the following formula 3:

$$F_{flank}=F_s \sin\theta_{eff}-F_{IO}*\sin\theta-F_{rg} \quad \text{formula (3)}$$

In the formula 3, only $F_{IO}*\sin\theta$ is an item relating to the rotational speed of the driving shaft 130. However, due to the weight of the Oldham coupling 190 is very small, this item may be negligible. $F_{rg}$ is an item independent of the rotational speed of the driving shaft 130, and may be considered as a constant. $F_s$ Sin $\theta_{eff}$ is also an item independent of the rotational speed of the driving shaft 130. In the case that the effective driving angle $\theta_{eff}$ is unchanged, it may be considered as a constant. However, the magnitude of this item can be varied by changing the effective driving angle $\theta_{eff}$ of the eccentric crank pin 32.

Thus, in the scroll compressor 10 according to the first embodiment of the present application, a radial sealing force $F_{flank}$ is a constant independent of the rotational speed of the driving shaft 130. In other words, regardless of the rotational speed of the driving shaft 30, a radial sealing force $F_{flank}$ is constant. On the other hand, since the magnitude of $F_s$ Sin $\theta_{eff}$ may be changed by changing the effective driving angle $\theta_{eff}$ of the eccentric crank pin 32, a desired radial sealing force may be adjusted by adjusting the effective driving angle $\theta_{eff}$. Thus, whether the scroll compressor 10 is in a low rotational speed condition or in a high rotational speed condition, a suitable radial sealing force can be achieved. It is possible to avoid efficiency of the compressor from being reduced due to the insufficient radial sealing force, and also to avoid the scroll components from excessive wear due to the excessive radial sealing force.

In addition, as described above, the gap C2 between the driving shaft 30 and the driving hole 48 of the movable scroll counterweight 40 in the radial direction is set to be equal to or greater than the gap C1 between the eccentric crank pin 32 and the unloading bushing 60 in a radial direction. As a result, the scroll compressor 10 according to the embodiments of the present application still has a radial flexibility.

Specifically, when uncompressible materials (such as solid impurities, lubricating oil and liquid refrigerant) enter the compression pockets and get stuck between the spiral wrap 156 and the spiral wrap 166, the movable scroll 160 may be displaced by C1 maximally in the radial direction due to the gap C1 between the eccentric crank pin 32 and the unloading bushing 60. Then, the foreign matters are allowed to pass between the spiral wrap 156 and the spiral wrap 166 radially spaced apart from one another. Meanwhile, since the cylindrical portion 42 of the movable scroll counterweight 40 is disposed at the outer periphery of the hub portion 162 of the movable scroll 160, when the movable scroll 160 is radially displaced, it may drive the movable scroll counterweight 40 to radially displace. In this case, since the gap C2 between the driving holes 48 of the movable scroll counterweight 40 and the driving shaft 30 is equal to or greater than the gap C1, the radial displacement of the movable scroll counterweight 40 may be free from the driving shaft 30. Therefore, the movable scroll 160 and the movable scroll counter weight 40 both may displace by a maximum distance of C1. Thus, a constant radial sealing force can be provided for the scroll compressor, and a radial flexibility can be still provided for the scroll compressor.

It will be understood by those skilled in the art that, in the case that a radial flexibility is not required for the scroll compressor, the unloading bushing 60 can be omitted, and the gap C2 need not be provided. In particular, the cooperation between the driving shaft and the movable scroll counterweight may be achieved by any structure that can cause the driving shaft to drive the movable scroll counterweight to rotate, which is not limited to the structure shown in FIGS. 6 and 7. For example, a D-shaped section may be provided on the driving shaft 30, and accordingly, the movable scroll counterweight 40 may have a matched D-shaped hole.

It will also be understood by those skilled in the art that, an example of the driving connection between the driving shaft 30 and the movable scroll counterweight 40 is given with reference to FIGS. 6 and 7 above, but the application is not limited thereto. In contrast, in view of providing a radial flexibility for the compressor, the driving portion 33 and the driving hole 48 may be configured to be of any configuration that enables a radial slide of the movable scroll counterweight 40 relative to the driving shaft 30. For example, a key may be provided on the driving shaft 30, and a key slot is provided in the driving hole 48, with the radial size of the driving hole 48 being set to be greater than the radial size of the driving shaft 30 such that the key of the driving shaft 30 can be fitted in the key slot of the driving hole 48 so as to drive the movable scroll counterweight to rotate while allowing the movable scroll counterweight to radially slide relative to the driving shaft along the key. As another example, the movable scroll counterweight 40 may include a hub portion downwardly extending to surround the driving shaft 30 and having an inner diameter larger than the outer diameter of the driving shaft, and a hole may be provided on each of the hub portion and the driving shaft, so that one pin may pass through the hole in the hub portion and then be fixed in the hole of the driving shaft. In this configuration, the driving shaft may also drive the movable scroll counterweight to rotate and allow the movable scroll counterweight to radially slide along the pin relative to the driving shaft. Based on the principle of the application, many other configurations can be readily contemplated by those skilled in the art, and will not be enumerated herein.

Figure 13:
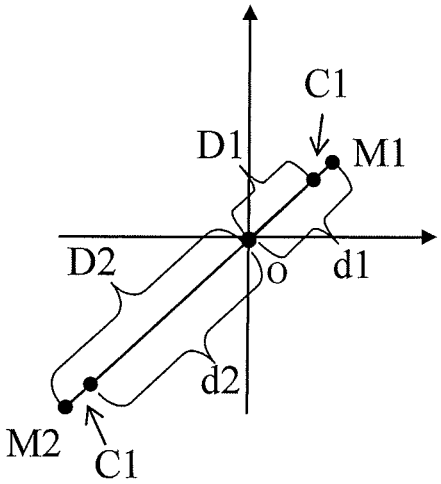
FIG. 13 is a schematic view of the relationship of the mass and the orbiting radius between the movable scroll and the movable scroll counterweight.

A relationship of the mass and orbiting radius between the movable scroll and the movable scroll counterweight will be described with reference to FIG. 13 below. As shown in FIG. 13, the center M2 of gravity of the movable scroll counterweight 40 and the center M1 of gravity of the movable scroll 160 are on opposite sides of the rotational axis O of the driving shaft 30. Assuming that the mass of the movable scroll 160 is M1 and the minimum orbiting radius of the movable scroll 160 is D1; and assuming that the mass of the movable scroll counterweight 40 is M2 and the maximum orbiting radius of the centroid of the movable scroll counterweight 40 is D2, the above parameters may be set to satisfy formula 4: $M1*D1 \geq M2*D2$. Further, it is assumed that a distance between the center of gravity of the movable scroll 160 and the rotational axis of the driving shaft 30 during a normal operation of the scroll compressor 10 is d1, then $D1=d1-C1$; and it is assumed that a distance between the center of gravity of the movable scroll counterweight 40 and the rotational axis of the driving shaft 30 during a normal operation of the scroll compressor 10 is d2, then $D2=d2+C1$. The "normal operation" means that the movable scroll of the scroll compressor moves without radial displacement (i.e. performing a radial flexibility).

From the above formulas, the mass and its orbiting radius of the movable scroll counterweight 40 can easily be set, and it is ensured that the movable scroll 160 can be securely engaged with the fixed scroll 150 in any case (including the case that a radial flexibility is performed).

Seeing FIGS. 16-20, the scroll compressor according to the second embodiment of the present application will be described below. This embodiment differs from the first embodiment in the cooperating and connection relationships between the movable scroll counterweight and the driving shaft as well as the hub portion of the movable scroll.

Specifically, a mated hole 36 may be provided in the outer peripheral surface of the driving shaft 30, and a driving hole 49 may also be formed in the bottom wall of the movable scroll counterweight 40. The movable scroll counterweight 40 and the driving shaft 30 may be connected to each other by a driving rod 70. A first end 72 of the driving rod 70 may be fitted in the mated hole 36 of the driving shaft 30, and a second end 74 of the driving rod 70 may be fitted in the driving hole 49 of the movable scroll counterweight 40. The cylindrical portion 42 of the movable scroll counterweight 40 is disposed to surround the hub portion 162 of the movable scroll 160. A snap spring 80 may be provided at the outer side of the hub portion 162 of the movable scroll 160 to axially hold the movable scroll counterweight 40. Thus, as the driving shaft 30 rotates, the driving shaft 30 drives the driving rod 70, which, in turn, drives the movable scroll counterweight 40 to rotate by the driving hole 49.

Figure 17A:
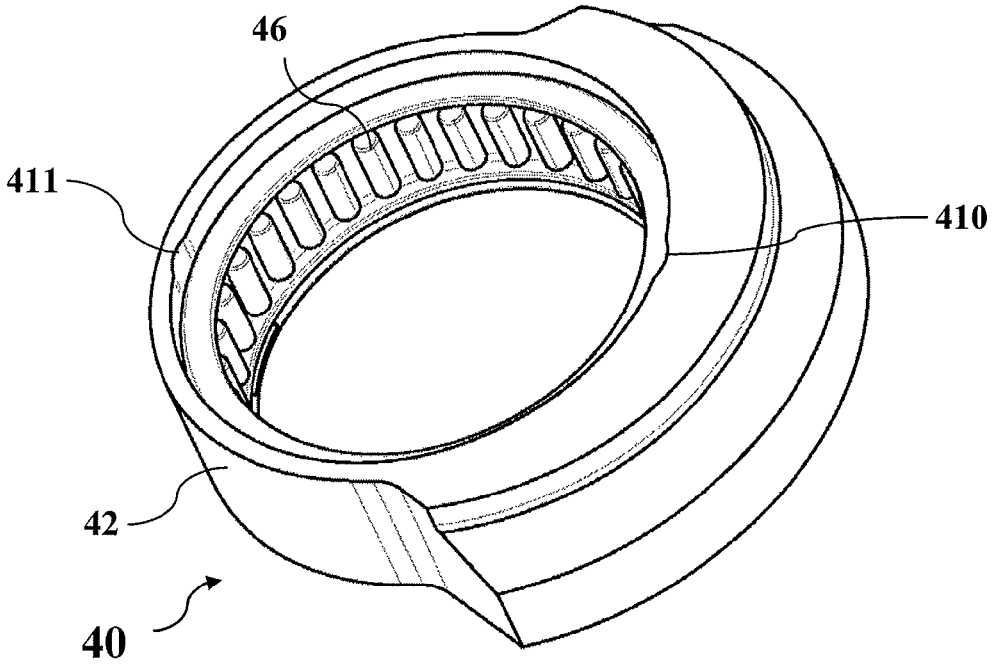
FIG. 17A and FIG. 17B show perspective views of a movable scroll counterweight according to the second embodiment of the application viewed from different directions.
Figure 17B:
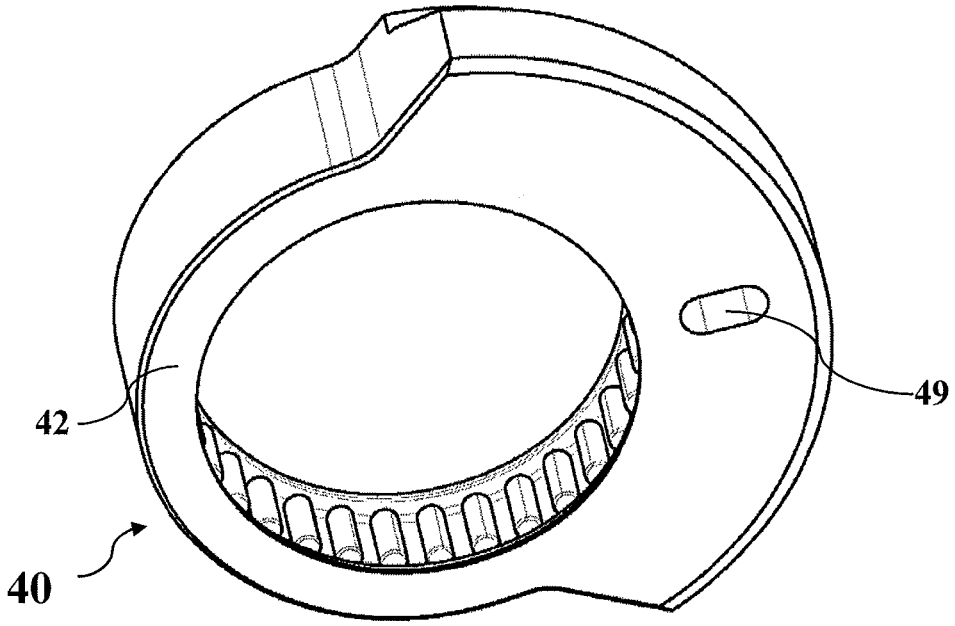
Figure 18:
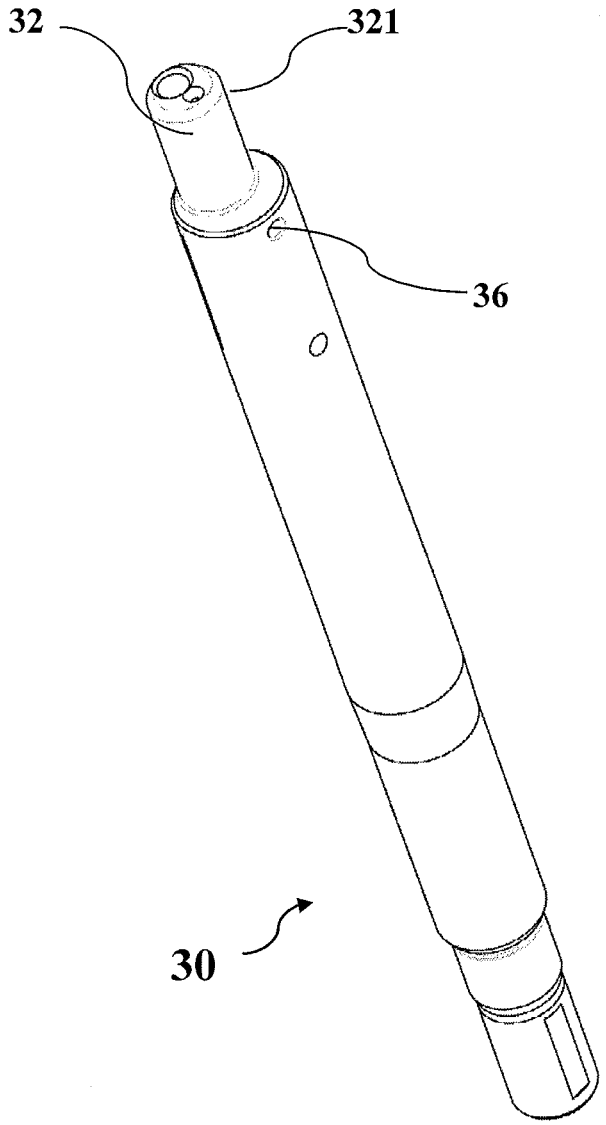
FIG. 18 shows a perspective view of a driving shaft according to the second embodiment of the application.
Figure 19:
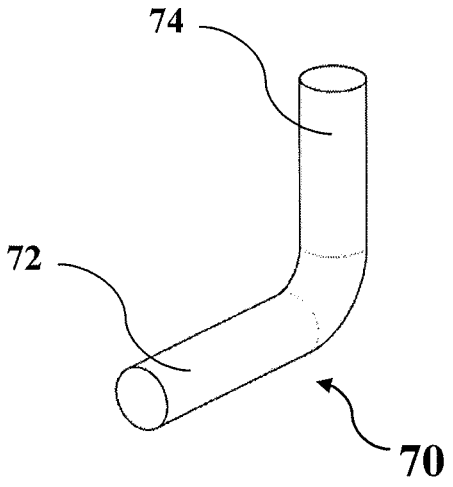
FIG. 19 shows a perspective view of a driving rod according to the second embodiment of the application.
Figure 20:
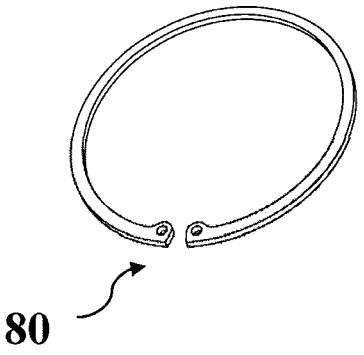
FIG. 20 shows a perspective view of a snap spring according to the second embodiment of the application.
Figure 21A:
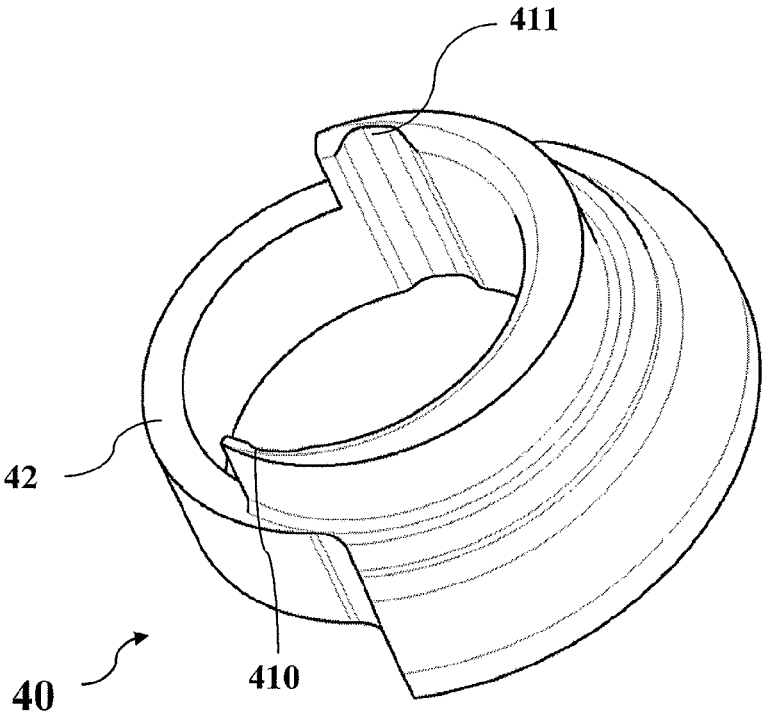
FIG. 21A and FIG. 21B show perspective views of a movable scroll counterweight according to a modification of the second embodiment of the application viewed from different directions.
Figure 21B:
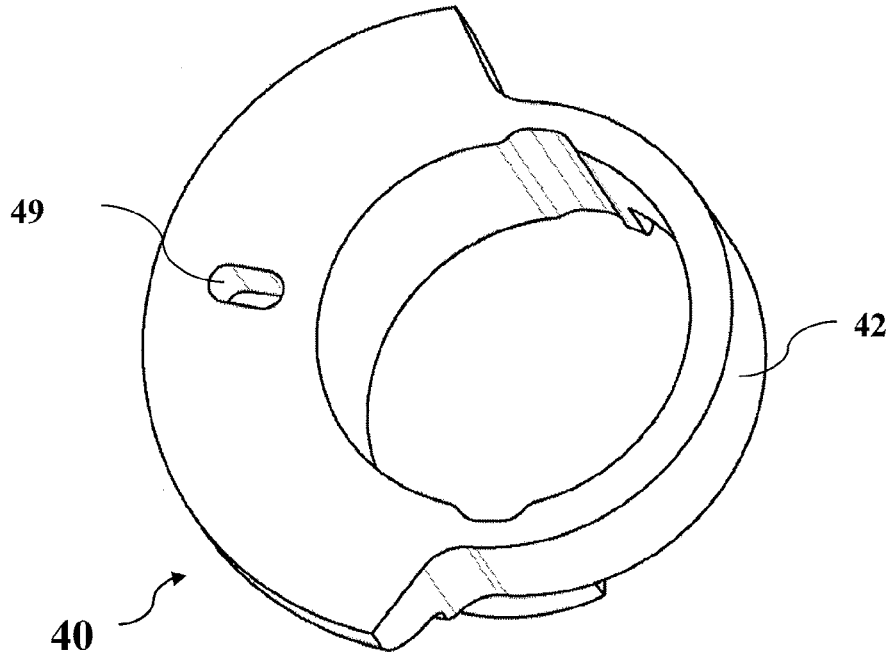

As shown in FIGS. 17A and 17B, a bearing 46 may be provided in the cylindrical portion 42, but the bearing 46 may also be omitted as variations shown in FIGS. 21A and 21B.

The driving rod 70 may be substantially L-shaped. However, those skilled in the art will understand that, the driving rod 70 may have any other suitable shape adapted to drive the movable scroll counterweight.

To achieve a radial flexibility of the scroll compressor, the driving hole 49 may be an elongated hole substantially extending in the radial direction of the movable scroll counterweight 40.

In this case, it is assumed that a gap between the eccentric crank pin 32 and the unloading bushing 60 in a radial direction parallel to the planar portion 321 of the eccentric crank pin 32 is C1, and it is assumed that the radial length of the elongated hole is C3, then the relationship between C1 and C3 may be set as $C3 \geq C1$.

Further, in the present embodiment, the relationship of the mass and orbiting radius between the movable scroll and the movable scroll counterweight can still be set to satisfy the above formula 4.

A lubricant supply structure of the movable scroll counterweight 40 will be described further with respect to FIGS. 7A and 7B below. More specifically, at least one oil supply groove 410 or 411 may be disposed on the inner circumference of the cylindrical portion 42 of the movable scroll counterweight 40. The oil supply grooves 410 and 411 may extend substantially in the axial direction of the scroll compressor. However, those skilled in the art will understand that, the oil supply grooves 410 and 411 may also extend in such a manner as being inclined relative to the axial direction of the scroll compressor. In FIGS. 7A and 7B, a pair of oil supply grooves 410, 411 are provided, for example, being substantially symmetric with respect to the rotational center of the movable scroll counterweight 40. Although the oil supply groove 410 is shown in FIGS. 7A and 7B to be disposed on one side of the cylindrical portion 42 close to a thickening portion 49, and the oil supply groove 411 is shown to be disposed on the other side of the cylindrical portion 42 opposite to the thickening portion 49, it will be understood by those skilled in the art that, the number and position of the oil supply groove can be set as desired. For example, in the example shown in FIG. 11, the oil supply grooves 410 and 411 may be provided on opposite sides of the thickening portion 49. The oil supply grooves 410 and 411 may extend to the bottom wall 44 of the movable scroll counterweight 40 in an axial direction.

Figure 22:
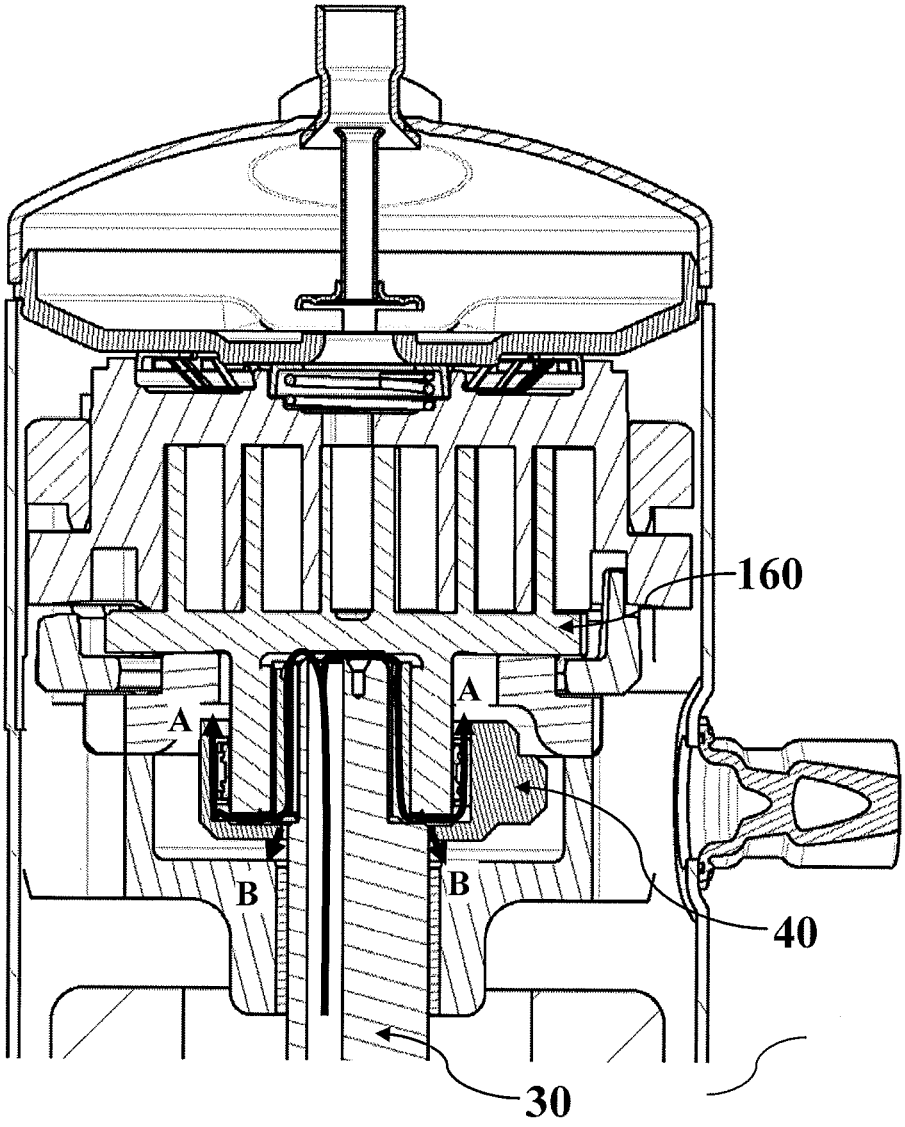
FIG. 22 shows a schematic view of the supply of lubricant in the scroll compressor according to the first embodiment of the application.

A lubrication system of the scroll compressor 10 will be described with reference to FIGS. 3 and 22 below. As shown in FIG. 3, the driving shaft 30 includes a central hole 37 substantially centrally located in the lower end thereof and an eccentric hole 38 extending upwardly to an end face of the eccentric crank pin 32 in the axial direction of the driving shaft 30 from the central hole 37. Lubricant at a bottom portion of the housing of the compressor is supplied into the central hole 37, for example, by a lubricant supply device such as a pump and moves further upwardly along the eccentric hole 38 under the centrifugal force induced through the rotation of the driving shaft 30, and finally is discharged from an end portion of the eccentric crank pin 32. Lubricant discharged from the eccentric crank pin 32 flows as indicated by arrows A and B. More specifically, a portion of lubricant indicated by the arrow A moves along the bottom wall 44 towards the radial outer side of the movable scroll counterweight 40 to a lower end of the oil supply grooves 410 and 411 under the action of centrifugal force. Then, the lubricant moves upwardly along the oil supply grooves 410 and 411 and, under the action of inertia, reaches thrust surfaces between the movable scroll end plate 164 and the thrust plate 50 for lubricating. In addition, in this process, the lubricant also lubricates the bearing 46 disposed on the inner side of the cylindrical portion 42. On the other hand, a portion of lubricant indicated by the arrow B will move downwardly under the action of gravity and will be accumulated in a recess of the main bearing housing 20. The lubricant accumulated in the recess of the main bearing housing 20 may continue to flow downwardly to pass through the main bearing 144 and, due to rotation of the driving shaft 30, may splash to other moving components so as to achieve the lubrication.

Figure 14:
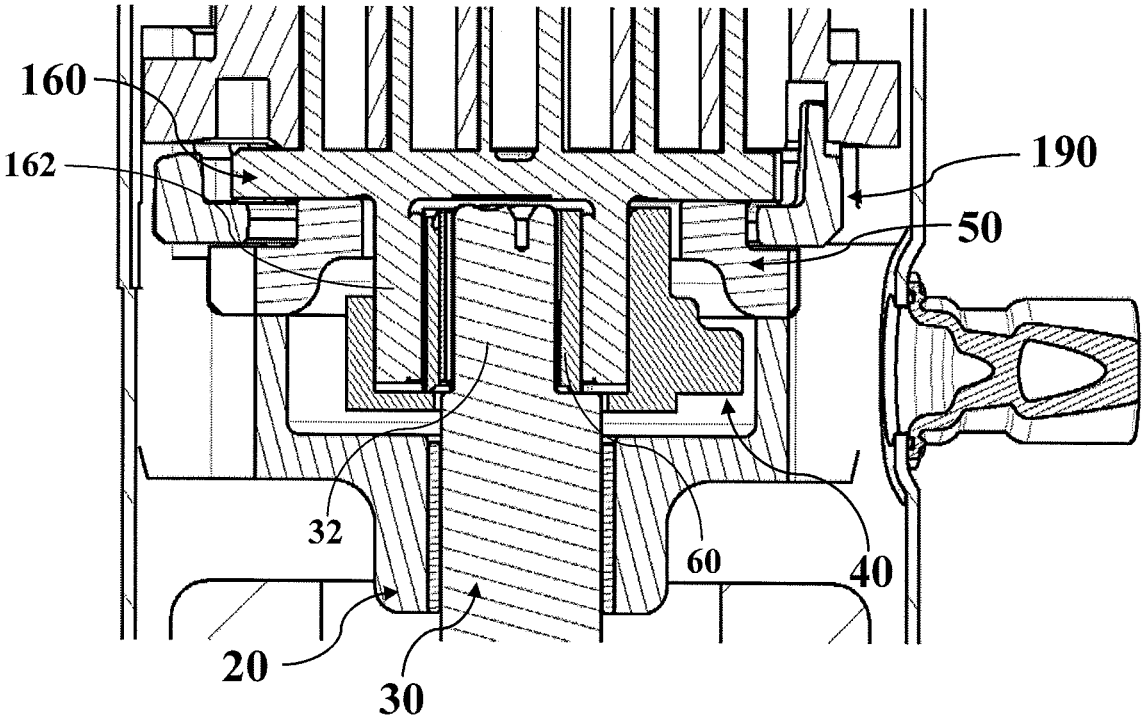
FIG. 14 shows a partial longitudinal sectional view of a scroll compressor according to a modification of the first embodiment of the application.
Figure 15A:
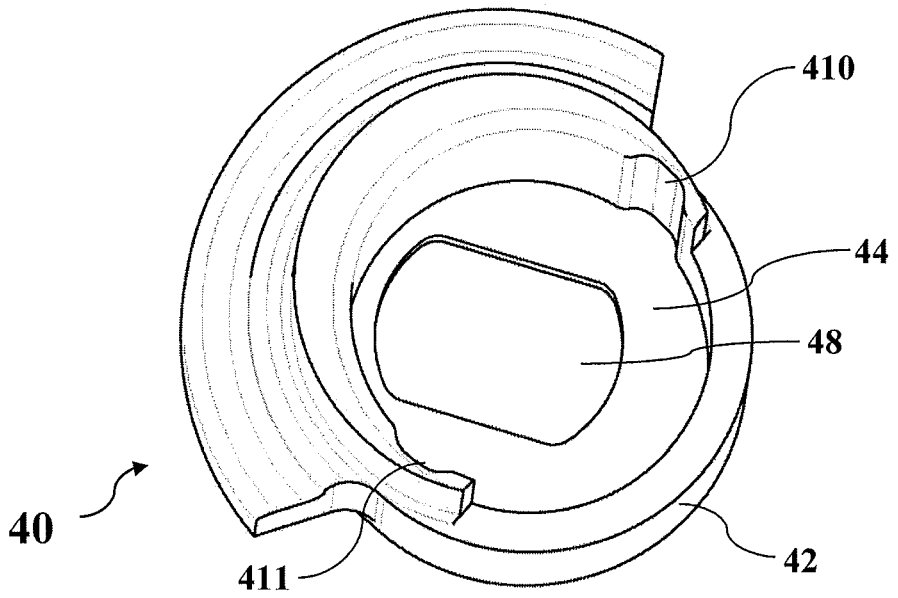
FIG. 15A and FIG. 15B show perspective views of a movable scroll counterweight according to a modification of the first embodiment of the application viewed from different directions.
Figure 15B:
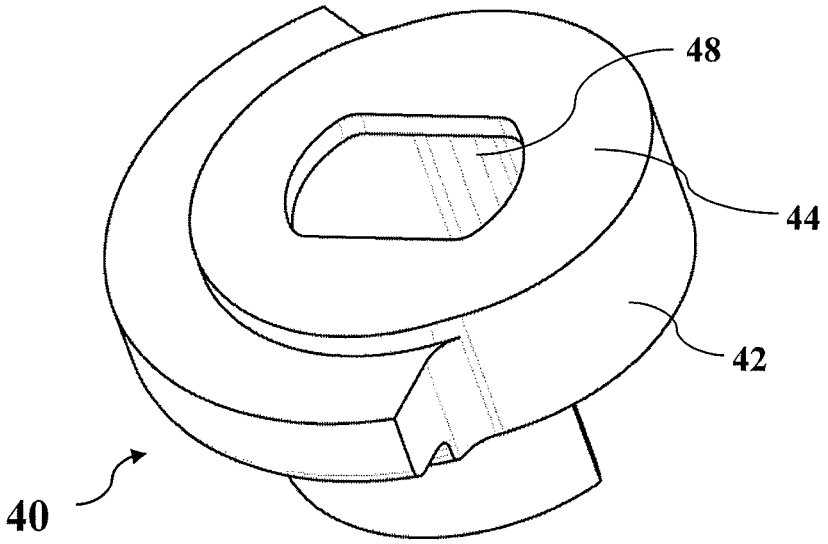
Figure 16:
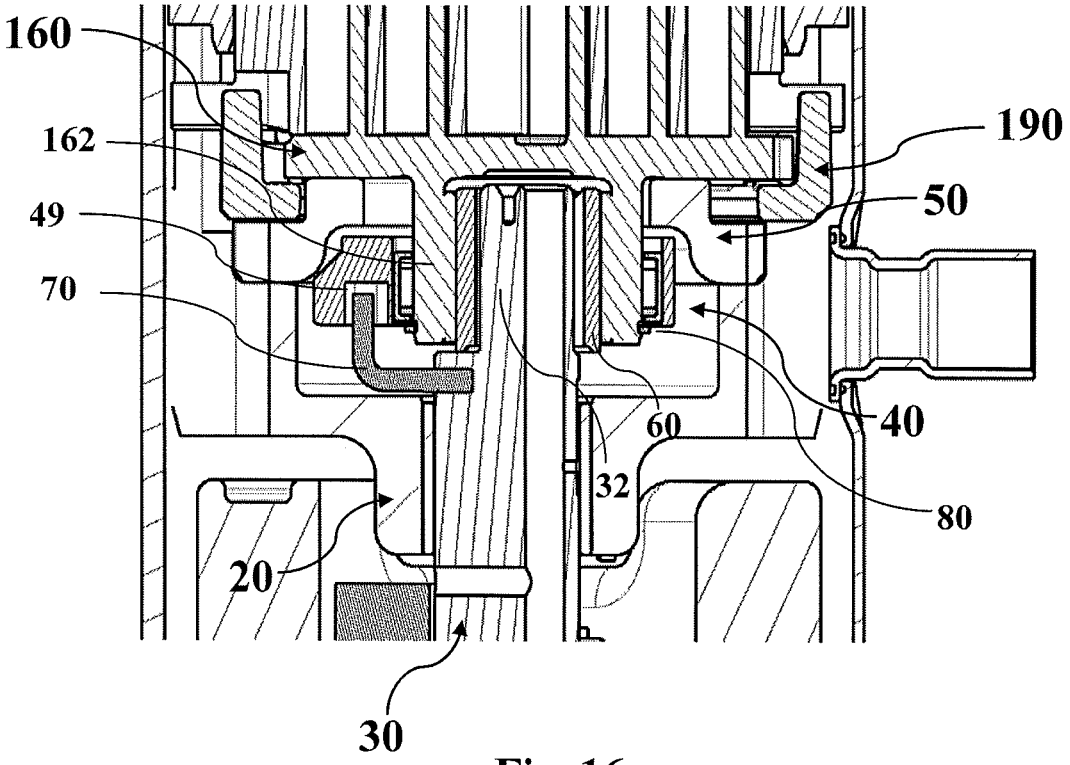
FIG. 16 shows a partial longitudinal sectional view of a scroll compressor according to a second embodiment of the application.

For better lubricating the thrust surfaces between the movable scroll end plate 164 and the thrust plate 50, for example, as shown in FIGS. 14, 15A and 15B, the portion, in which the oil supply grooves 410 and 411 are provided, of the cylindrical portion 42 of the movable scroll counterweight 40 can be higher than the other portions of the cylindrical portion 42, or may be configured to be adjacent to a lower surface of the movable scroll end plate 164. Thus, the lubricant can flow along the oil supply grooves 410 and 411 to a position that is closer to the movable scroll end plate 164, thereby achieving a better lubrication effect.

Further, referring to FIGS. 7A and 7B, a step portion 412 protruding from the bottom wall 44 may also be formed on the bottom wall 44 of the movable scroll counterweight 40. The oil supply grooves 410, 411 may extend axially to the step portion 412. Although the step portion 412 is shown as a step portion that extends annularly in a circumferential direction in FIGS. 7A and 7B, it will be understood by those skilled in the art that the step portion 412 may also be formed only in the vicinity of the lower end of the oil supply grooves 410, 411. The height of the step portion 412 protruding relative to the bottom wall 44 may be set such that a ratio of the lubricant flowing upwardly through the oil supply grooves 410, 411 (the lubricant as designated by the arrow A in FIG. 22) to the lubricant flowing downwardly through the driving hole 48 formed in the bottom wall 44 (the lubricant as designated by the arrow B in FIG. 22) reaches a predetermined value. Thus, by designing the height of the step portion 412, the amount of lubricant supplied to the various parts can be easily controlled, thereby achieving an optimization of the lubricating and working efficiency of the compressor.

Further, for example, the bottom wall 44 of the movable scroll counterweight 40 may be omitted, as shown in FIGS. 17A, 17B and FIGS. 21A and 21B. In this case, since the lubricant may splash with the rotation of the driving shaft 30, the oil supply grooves 410, 411 formed in the cylindrical portion 42 still contribute to supplying the lubricant to the thrust surfaces between the movable scroll end plate 164 and the thrust plate 50 and supplying the lubricant between the movable scroll counterweight 40 and the hub portion 162 of the movable scroll 160.

Although various embodiments of the application have been described in detail herein, it should be understood that the application is not limited to the specific embodiments described and illustrated in detail herein. Without departing from the spirit and scope of the application, other modifications and variations can be implemented by the person skilled in the art. All such modifications and variations are within the scope of the present application. Moreover, all the members described herein may be replaced by other technically equivalent members.

The invention claimed is:

1. A scroll compressor, comprising:

a fixed scroll comprising a fixed scroll end plate and a fixed scroll wrap formed on one side of the fixed scroll end plate;

a movable scroll comprising a movable scroll end plate, a movable scroll wrap formed on one side of the movable scroll end plate and a hub portion formed on the other side of the movable scroll end plate;

a driving shaft comprising an eccentric crank pin, the eccentric crank pin being fitted in the hub portion of the movable scroll to drive the movable scroll; and a movable scroll counterweight configured to be able to rotate with the driving shaft and to generate a centrifugal force by rotation which acts on the hub portion of the movable scroll;

wherein the movable scroll counterweight comprises a cylindrical portion, the cylindrical portion is provided around the hub portion of the movable scroll, and at least a portion of the cylindrical portion contacts an outer side of the hub portion; and wherein a driving portion for driving the movable scroll counterweight to rotate is provided on an outer peripheral surface of the driving shaft, the movable scroll counterweight comprises a bottom wall, and a driving hole for being engaged with the driving portion to enable the rotation of the movable scroll counterweight together with the driving shaft is provided in the bottom wall.

2. The scroll compressor according to claim 1, wherein a direction of the centrifugal force of the movable scroll counterweight is opposite to a direction of a centrifugal force of the movable scroll.

3. The scroll compressor of claim 2, wherein the centrifugal force of the movable scroll counterweight is set to be approximately equal to the centrifugal force of the movable scroll.

4. The scroll compressor according to claim 1, wherein the driving portion has a shape corresponding to a shape of the driving hole.

5. The scroll compressor according to claim 4, wherein the driving portion has a non-circular cross-section.

6. The scroll compressor according to claim 4, wherein a maximum size of the driving portion in a radial direction is less than or equal to a maximum size of the driving hole in the radial direction.

7. The scroll compressor according to claim 1, wherein the driving portion and the driving hole are configured such as to allow the movable scroll counterweight to slide on the driving portion in a radial direction.

8. The scroll compressor according to claim 7, wherein the driving portion comprises two step portions, each of the step portions comprising a bottom surface and a side surface, and the side surfaces of the two step portions being parallel to one another.

9. The scroll compressor according to claim 8, wherein the driving hole has two side walls able to be fitted with the side surfaces of the two step portions.

10. The scroll compressor according to claim 9, wherein the eccentric crank pin of the driving shaft is fitted in the hub portion of the movable scroll via an unloading bushing, the eccentric crank pin comprises a planar portion extending in parallel to a rotational axis of the driving shaft, and the unloading bushing comprises a planar portion corresponding to the planar portion of the eccentric crank pin.

11. The scroll compressor according to claim 10, wherein if a gap between the eccentric crank pin and the unloading bushing in a radial direction parallel to the planar portion of the eccentric crank pin is C1, and if a gap between the driving shaft and the driving hole of the movable scroll counterweight in a radial direction parallel to the side walls of the driving hole is C2, then the relationship between C1 and C2 is set as $C2 \geq C1$.

12. The scroll compressor according to claim 11, wherein a center of gravity of the movable scroll counterweight and a center of gravity of the movable scroll are located on opposite sides of the rotational axis of the driving shaft.

13. The scroll compressor according to claim 12, wherein if the movable scroll has a mass of M1 and a minimum orbiting radius of D1, and if the movable scroll counterweight has a mass of M2 and a maximum orbiting radius of a centroid of D2, then these parameters are set to satisfy a formula: $M1*D1 \geq M2*D2$.

14. The scroll compressor according to claim 13, wherein if a distance between the center of gravity of the movable scroll and the rotational axis of the driving shaft is d1 during a normal operation of the scroll compressor, then $D1=d1-C1$; and if a distance between the center of gravity of the movable scroll counterweight and the rotational axis of the driving shaft is d2 during a normal operation of the scroll compressor, then $D2=d2+C1$.

15. The scroll compressor according to claim 1, further comprises:

a matched hole provided in an outer peripheral surface of the driving shaft, a driving rod having a first end fitted in the matched hole of the driving shaft and a second end fitted in the driving hole of the movable scroll counterweight.

16. The scroll compressor according to claim 15, further comprising a snap spring configured to allow the movable scroll counterweight to be fixedly fitted on the hub portion of the movable scroll.

17. The scroll compressor according to claim 15, wherein the eccentric crank pin of the driving shaft is fitted in the hub portion of the movable scroll via an unloading bushing, the eccentric crank pin comprises a planar portion extending in parallel to a rotational axis of the driving shaft, and the unloading bushing comprises a planar portion corresponding to the planar portion of the eccentric crank pin.

18. The scroll compressor according to claim 17, wherein the driving hole is an elongated hole substantially extending in a radial direction of the movable scroll counterweight.

19. The scroll compressor according to claim 18, wherein if a gap between the eccentric crank pin and the unloading bushing in a radial direction parallel to the planar portion of the eccentric crank pin is C1, and if a radial length of the elongated hole is C3, then the relationship between C1 and C3 is set as C3≥C1.

20. The scroll compressor according to claim 19, wherein a center of gravity of the movable scroll counterweight and a center of gravity of the movable scroll are located on opposite sides of the rotational axis of the driving shaft.

21. The scroll compressor according to claim 20, wherein if the movable scroll has a mass of M1 and a minimum orbiting radius of D1, and if the movable scroll counterweight has a mass of M2 and a maximum orbiting radius of a centroid of D2, then these parameters are set to satisfy a formula: M1*D1≥M2*D2.

22. The scroll compressor according to claim 21, wherein if a distance between the center of gravity of the movable scroll and the rotational axis of the driving shaft is d1 during a normal operation of the scroll compressor, then D1=d1−C1; and if a distance between the center of gravity of the movable scroll counterweight and the rotational axis of the driving shaft is d2 during the normal operation of the scroll compressor, then D2=d2+C1.

23. The scroll compressor according to claim 1, further comprising a main bearing housing for supporting the driving shaft and a thrust plate for supporting the end plate of the movable scroll, the main bearing housing and the thrust plate being separate components and fixed together by a fastening device.

24. The scroll compressor according to claim 1, further comprising a main bearing housing for supporting the driving shaft and a thrust plate for supporting the end plate of the movable scroll, wherein the main bearing housing and the thrust plate are integrally formed.

25. The scroll compressor according to claim 1, wherein at least one oil supply groove is provided on an inner circumference of the cylindrical portion.

26. The scroll compressor according to claim 25, wherein a pair of the oil supply grooves are arranged substantially symmetrically with respect to a rotation center of the movable scroll counterweight.

27. The scroll compressor according to claim 25, wherein a portion, in which the oil supply groove is provided, of the cylindrical portion of the movable scroll counterweight is higher than the other portions of the cylindrical portion.

28. The scroll compressor according to claim 25, wherein a portion, in which the oil supply groove is provided, of the cylindrical portion of the movable scroll counterweight is higher than the other portions of the cylindrical portion.

29. The scroll compressor according to claim 25, wherein the bottom wall is formed on the movable scroll counterweight with a step portion protruding from the bottom wall.

30. A scroll comprising:

a fixed scroll comprising a fixed scroll end plate and a fixed scroll wrap formed on one side of the fixed scroll end plate;

a movable scroll comprising a movable scroll end plate, a movable scroll wrap formed on one side of the movable scroll end plate and a hub portion formed on the other side of the movable scroll end plate;

a driving shaft comprising an eccentric crank pin, the eccentric crank pin being fitted in the hub portion of the movable scroll to drive the movable scroll; and a movable scroll counterweight configured to be able to rotate with the driving shaft and to generate a centrifugal force by rotation which acts on the hub portion of the movable scroll;

wherein the movable scroll counterweight comprises a cylindrical portion, the cylindrical portion is provided around the hub portion of the movable scroll, and wherein a bearing is provided in the cylindrical portion of the movable scroll counterweight, and an inner side of the bearing contacts the outer side of the hub portion; and wherein a driving portion for driving the movable scroll counterweight to rotate is provided on an outer peripheral surface of the driving shaft, the movable scroll counterweight comprises a bottom wall, and a driving hole for being engaged with the driving portion to enable the rotation of the movable scroll counterweight together with the driving shaft, the driving hole being provided in the bottom wall.

* * * * *